US008586521B2

(12) United States Patent
Brooker et al.

(10) Patent No.: US 8,586,521 B2
(45) Date of Patent: Nov. 19, 2013

(54) METHOD OF LAUNDERING FABRICS AT LOW TEMPERATURE

(75) Inventors: Alan Thomas Brooker, Newcastle upon Tyne (GB); Philip Frank Souter, Northumberland (GB)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 13/371,777

(22) Filed: Feb. 13, 2012

(65) Prior Publication Data

US 2012/0151684 A1 Jun. 21, 2012

Related U.S. Application Data

(63) Continuation of application No. PCT/US2010/043366, filed on Jul. 27, 2010.

(30) Foreign Application Priority Data

Aug. 13, 2009 (EP) ..... 09010447

(51) Int. Cl.

| | |
|---|---|
| ***C11D 1/02*** | (2006.01) |
| ***C11D 3/39*** | (2006.01) |
| ***C11D 3/395*** | (2006.01) |
| ***C11D 3/08*** | (2006.01) |
| ***C11D 3/10*** | (2006.01) |

(52) U.S. Cl.

USPC ..... 510/313; 510/302; 510/303; 510/309; 510/310; 510/336; 510/337; 510/349; 510/370; 510/375; 510/376; 510/438; 510/441; 510/445; 510/446; 510/475; 510/500; 510/507; 8/111; 8/137

(58) Field of Classification Search

USPC ..... 510/302, 303, 309, 310, 336, 337, 349, 510/370, 375, 376, 438, 441, 445, 446, 475, 510/500, 507, 313; 8/111, 137

See application file for complete search history.

(56) References Cited

U.S. PATENT DOCUMENTS

| | | | | |
|---|---|---|---|---|
| 4,743,394 | A | 5/1988 | Kaufmann | |
| 5,458,801 | A * | 10/1995 | Oyashiki et al. | 252/186.25 |
| 5,482,646 | A | 1/1996 | Mazzola | |
| 5,945,394 | A | 8/1999 | Sajic et al. | |
| 6,197,740 | B1 | 3/2001 | Shikata et al. | |
| 6,207,633 | B1 | 3/2001 | Kettenacker et al. | |
| 6,274,545 | B1 | 8/2001 | Mazzola | |
| 7,169,744 | B2 | 1/2007 | Miracle et al. | |
| 7,557,076 | B2 | 7/2009 | Miracle et al. | |
| 2006/0183658 | A1 * | 8/2006 | Sadlowski et al. | 510/392 |
| 2006/0234893 | A1 * | 10/2006 | Busch et al. | 510/376 |
| 2007/0173428 | A1 * | 7/2007 | Appleby et al. | 510/309 |
| 2008/0194454 | A1 * | 8/2008 | Morgan et al. | 512/1 |

FOREIGN PATENT DOCUMENTS

| | | | |
|---|---|---|---|
| EP | 0890635 | A | 1/1999 |
| FR | 1059696 | A | 3/1954 |
| FR | 1115755 | A | 4/1956 |
| GB | 1013394 | A | 12/1965 |
| GB | 2289687 | A | 11/1995 |

OTHER PUBLICATIONS

International Search Report dated Sep. 30, 2011, containing 9 pages.

* cited by examiner

*Primary Examiner* — Gregory Delcotto

(74) *Attorney, Agent, or Firm* — Gary J. Foose

(57) ABSTRACT

The present invention relates to a method of laundering fabric comprising the step of contacting a laundry detergent composition to water to form a wash liquor, and laundering fabric in said wash liquor, wherein the wash liquor has a temperature of above 0° C. to 20° C., and wherein the laundry detergent composition comprises greater than 1 wt % detersive surfactant and other detergent ingredients.

13 Claims, No Drawings

METHOD OF LAUNDERING FABRICS AT LOW TEMPERATURE

CROSS REFERENCE TO RELATED APPLICATION

This application is a Continuation of PCT/US2010/043366, filed Jul. 27, 2010.

FIELD OF THE INVENTION

The present invention relates to a method of laundering fabric. The method exhibits good fabric cleaning performance, good fabric care profile, good fabric freshness profile, and has an excellent environmental profile.

BACKGROUND OF THE INVENTION

With the move to more environmentally friendly and sustainable laundry products, laundering processes, and laundry washing machine applications, there is a need to ensure that the fabric cleaning, fabric care and fabric freshness profiles remain acceptable. With lower wash temperatures, the dissolution performance is impaired, especially of solid laundry detergent products. In addition, the reaction kinetics of the laundering processes are reduced with lower wash temperatures. The fabric deposition performance is also affected by lowering the wash temperature. The perfume release profile also changes with lowering wash temperatures.

The inventors have found that certain detergent ingredients, and certain combinations of detergent ingredients enable low temperature laundering of fabric in a more environmentally friendly and sustainable manner, whilst ensuring good fabric cleaning performance, good fabric care profile, and good fabric freshness profile.

SUMMARY OF THE INVENTION

The present invention relates to a method of laundering fabric as defined by the claims.

DETAILED DESCRIPTION OF THE INVENTION

Method of Laundering Fabric

The method of laundering fabric comprises the step of contacting a laundry detergent composition to water to form a wash liquor, and laundering fabric in said wash liquor, wherein the wash liquor has a temperature of above 0° C. to 20° C., preferably to 19° C., or to 18° C., or to 17° C., or to 16° C., or to 15° C., or to 14° C., or to 13° C., or to 12° C., or to 11° C., or to 10° C., or to 9° C., or to 8° C., or to 7° C., or to 6° C., or even to 5° C. The fabric may be contacted to the water prior to, or after, or simultaneous with, contacting the laundry detergent composition with water.

Typically, the wash liquor is formed by contacting the laundry detergent to water in such an amount so that the concentration of laundry detergent composition in the wash liquor is from above 0 g/l to 5 g/l preferably from 1 g/l, and preferably to 4.5 g/l, or to 4.0 g/l, or to 3.5 g/l, or to 3.0 g/l, or to 2.5 g/l, or even to 2.0 g/l, or even to 1.5 g/l.

Highly preferably, the method of laundering fabric is carried out in a front-loading automatic washing machine. In this embodiment, the wash liquor formed and concentration of laundry detergent composition in the wash liquor is that of the main wash cycle. Any input of water during any optional rinsing step(s) that typically occurs when laundering fabric using a front-loading automatic washing machine is not included when determining the volume of the wash liquor. Of course, any suitable automatic washing machine may be used, although it is extremely highly preferred that a front-loading automatic washing machine is used.

It is highly preferred for the wash liquor to comprise 40 liters or less of water, preferably 35 liters or less, preferably 30 liters or less, preferably 25 liters or less, preferably 20 liters or less, preferably 15 liters or less, preferably 12 liters or less, preferably 10 liters or less, preferably 8 liters or less, or even 6 liters or less of water. Preferably, the wash liquor comprises from above 0 to 15 liters, or from 1 liter, or from 2 liters, or from 3 liters, and preferably to 12 liters, or to 10 liters, or even to 8 liters of water. Most preferably, the wash liquor comprises from 1 liter, or from 2 liters, or from 3 liters, or from 4 liters, or even from 5 liters of water.

Typically from 0.01 kg to 2 kg of fabric per liter of wash liquor is dosed into said wash liquor. Typically from 0.01 kg, or from 0.02 kg, or from 0.03 kg, or from 0.05 kg, or from 0.07 kg, or from 0.10 kg, or from 0.12 kg, or from 0.15 kg, or from 0.18 kg, or from 0.20 kg, or from 0.22 kg, or from 0.25 kg fabric per liter of wash liquor is dosed into said wash liquor.

Preferably 50 g or less, more preferably 45 g or less, or 40 g or less, or 35 g or less, or 30 g or less, or 25 g or less, or 20 g or less, or even 15 g or less, or even 10 g or less of laundry detergent composition is contacted to water to form the wash liquor.

Preferably, the laundry detergent composition is contacted to from above 0 liters, preferably from above 1 liter, and preferably to 70 liters or less of water to form the wash liquor, or preferably to 40 liters or less of water, or preferably to 35 liters or less, or preferably to 30 liters or less, or preferably to 25 liters or less, or preferably to 20 liters or less, or preferably to 15 liters or less, or preferably to 12 liters or less, or preferably to 10 liters or less, or preferably to 8 liters or less, or even to 6 liters or less of water to form the wash liquor.

Especially preferably, catalytic ingredients are used to improve the cleaning performance of the laundry detergent composition during the process of the present invention. Catalytic ingredients are also preferably used to improve the hygiene profile of the laundry detergent composition during the method of the present invention.

Laundry Detergent Composition

The laundry detergent composition comprises and wherein the laundry detergent composition comprises greater than 1 wt % detersive surfactant and other detergent ingredients.

The composition can be any form, for example a solid powder or tablet form, or a liquid including gel form, or any combination thereof. The composition may be in any unit dose form, for example a tablet or a pouch, or even a detergent sheet. However, it is extremely highly preferred for the composition to be in solid form, and it is especially preferred for the composition to be in a solid free-flowing particulate form, for example such that the composition is in the form of separate discrete particles.

The laundry detergent composition may comprise from 0 wt % to 40 wt %, or from above 0 wt %, and preferably to 30 wt %, or to 25 wt %, or to 20 wt %, or to 15 wt %, or to 10 wt %, or to 8 wt, or to 6 wt %, or to 4 wt %, or to 2 wt % water. This may be preferred if the composition is in liquid including gel form, and/or unit dose form such as a unit dose pouch.

The composition is a fully finished laundry detergent composition. Typically, if the composition is in free-flowing particulate form, the composition comprises a plurality of chemically different particles populations. The composition is not just a component of a laundry detergent composition that can be incorporated into a laundry detergent composition (such as an enzyme prill, or a surfactant particle, or a bleach particle), it is a fully finished laundry detergent composition. That said, it is within the scope of the present invention for an additional rinse additive composition (e.g. fabric conditioner or enhancer), or a main wash additive composition (e.g. bleach additive) to also be used in combination with the laundry detergent composition during the method of the present invention. Although, it may be preferred for no bleach additive composition is used in combination with the laundry detergent composition during the method of the present invention.

The laundry detergent composition preferably comprises from 0 wt % to less than 10 wt % zeolite builder, and from 0 wt % to less than 10 wt % phosphate builder. The laundry detergent composition may comprise cationic polymer. The laundry detergent composition may preferably comprise perfume microcapsule.

A highly preferred laundry detergent composition is a solid laundry detergent composition comprising: (a) alkyl ethoxylated sulphate having an average degree of ethoxylation of from 0.5 to 3.5; (b) from 0 wt % to 10 wt % zeolite builder; (c) from 0 wt % to 10 wt % phosphate builder; (d) enzyme; (e) bleach catalyst having a structure corresponding to general formula below:

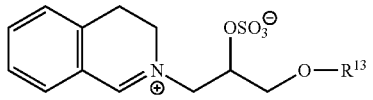

wherein $R^{13}$ is selected from the group consisting of 2-ethylhexyl, 2-propylheptyl, 2-butyloctyl, 2-pentylnonyl, 2-hexyldecyl, n-dodecyl, n-tetradecyl, n-hexadecyl, n-octadecyl, iso-nonyl, iso-decyl, iso-tridecyl and iso-pentadecyl; (f) layered particle, wherein the layered particle comprises a core and a layer, wherein the core comprises a source of hydrogen peroxide, wherein the layer comprises a binder and a bleach activator, and wherein the weight ratio of the source of hydrogen peroxide to the bleach activator is from about 5:1 to about 1.1:1; (g) optionally, transition metal bleach catalyst; (h) optionally, hueing agent; and (i) optionally, from 0 wt % to 10 wt % sodium carbonate.

Bleach Ingredient

Preferably the laundry detergent composition comprises a bleach ingredient, the bleach ingredient has a log $P_{o/w}$ no greater than 0, preferably no greater than −0.5, preferably no greater than −1.0, preferably no greater than −1.5, preferably no greater than −2.0, preferably no greater than −2.5, preferably no greater than −3.0, even more preferably no greater than −3.5. The method for determining log $P_{o/w}$ is described in more detail below.

Typically, the bleach ingredient is capable of generating a bleaching species having a $X_{SO}$ of from 0.01 to about 0.30, preferably from 0.05 to about 0.25, even more preferably from about 0.10 to 0.20. The method for determining $X_{SO}$ is described in more detail below. For example, bleaching ingredients having an isoquinolinium structure are capable of generating a bleaching species that has an oxaziridinium structure. In this example, the $X_{SO}$ is that of the oxaziridinium bleaching species.

Without wishing to be bound by theory, the inventors believe that controlling the electophilicity and hydrophobicity in this above described manner enables the bleach ingredient to be delivered substantially only to areas of the fabric that are more hydrophobic, and that contain electron rich soils, including visible chromophores, that are susceptible to bleaching by highly electrophilic oxidants.

Preferably, the bleaching ingredient is catalytic. A highly preferred bleach ingredient is a bleach catalyst that is capable of accepting an oxygen atom from a peroxyacid and/or salt thereof, and transferring the oxygen atom to an oxidizeable substrate. Suitable bleach catalysts include, but are not limited to: iminium cations and polyions; iminium zwitterions; modified amines; modified amine oxides; N-sulphonyl imines; N-phosphonyl imines; N-acyl imines; thiadiazole dioxides; perfluoroimines; cyclic sugar ketones and mixtures thereof.

Suitable iminium cations and polyions include, but are not limited to, N-methyl-3,4-dihydroisoquinolinium tetrafluoroborate, prepared as described in Tetrahedron (1992), 49(2), 423-38 (see, for example, compound 4, p. 433); N-methyl-3,4-dihydroisoquinolinium p-toluene sulphonate, prepared as described in U.S. Pat. No. 5,360,569 (see, for example, Column 11, Example 1); and N-octyl-3,4-dihydroisoquinolinium p-toluene sulphonate, prepared as described in U.S. Pat. No. 5,360,568 (see, for example, Column 10, Example 3).

Suitable iminium zwitterions include, but are not limited to, N-(3-sulfopropyl)-3,4-dihydroisoquinolinium, inner salt, prepared as described in U.S. Pat. No. 5,576,282 (see, for example, Column 31, Example II); N[2-(sulphooxy)dodecyl]-3,4-dihydroisoquinolinium, inner salt, prepared as described in U.S. Pat. No. 5,817,614 (see, for example, Column 32, Example V); 2-[3-[(2-ethylhexyl)oxy]-2-(sulphooxy)propyl]-3,4-dihydroisoquinolinium, inner salt, prepared as described in WO05/047264 (see, for example, page 18, Example 8), and 2-[3-[(2-butyloctyl)oxyl]-2-(sulphooxy)propyl]-3,4-dihydroisoquinolinium, inner salt.

Suitable modified amine oxygen transfer catalysts include, but are not limited to, 1,2,3,4-tetrahydro-2-methyl-1-isoquinolinol, which can be made according to the procedures described in Tetrahedron Letters (1987), 28(48), 6061-6064. Suitable modified amine oxide oxygen transfer catalysts include, but are not limited to, sodium 1-hydroxy-N-oxy-N-[2-(sulphooxy)decyl]-1,2,3,4-tetrahydroisoquinoline.

Suitable N-sulphonyl imine oxygen transfer catalysts include, but are not limited to, 3-methyl-1,2-benzisothiazole 1,1-dioxide, prepared according to the procedure described in the Journal of Organic Chemistry (1990), 55(4), 1254-61.

Suitable N-phosphonyl imine oxygen transfer catalysts include, but are not limited to, [R-(E)]-N-[(2-chloro-5-nitrophenyl)methylene]-P-phenyl-P-(2,4,6-trimethylphenyl)-phosphinic amide, which can be made according to the procedures described in the Journal of the Chemical Society, Chemical Communications (1994), (22), 2569-70.

Suitable N-acyl imine oxygen transfer catalysts include, but are not limited to, [N(E)]-N-(phenylmethylene)acetamide, which can be made according to the procedures described in Polish Journal of Chemistry (2003), 77(5), 577-590.

Suitable thiadiazole dioxide oxygen transfer catalysts include but are not limited to, 3-methyl-4-phenyl-1,2,5-thiadiazole 1,1-dioxide, which can be made according to the procedures described in U.S. Pat. No. 5,753,599 (Column 9, Example 2).

Suitable perfluoroimine oxygen transfer catalysts include, but are not limited to, (Z)-2,2,3,3,4,4,4-heptafluoro-N-(nonafluorobutyl)butanimidoyl fluoride, which can be made according to the procedures described in Tetrahedron Letters (1994), 35(34), 6329-30.

Suitable cyclic sugar ketone oxygen transfer catalysts include, but are not limited to, 1,2:4,5-di-O-isopropylidene- D-erythro-2,3-hexodiuro-2,6-pyranose as prepared in U.S. Pat. No. 6,649,085 (Column 12, Example 1).

Preferably, the bleach catalyst comprises an iminium and/or carbonyl functional group and is typically capable of forming an oxaziridinium and/or dioxirane functional group upon acceptance of an oxygen atom, especially upon acceptance of an oxygen atom from a peroxyacid and/or salt thereof. Preferably, the bleach catalyst comprises an oxaziridinium functional group and/or is capable of forming an oxaziridinium functional group upon acceptance of an oxygen atom, especially upon acceptance of an oxygen atom from a peroxyacid and/or salt thereof. Preferably, the bleach catalyst comprises a cyclic iminium functional group, preferably wherein the cyclic moiety has a ring size of from five to eight atoms (including the nitrogen atom), preferably six atoms. Preferably, the bleach catalyst comprises an aryliminium functional group, preferably a bi-cyclic aryliminium functional group, preferably a 3,4-dihydroisoquinolinium functional group. Typically, the imine functional group is a quaternary imine functional group and is typically capable of forming a quaternary oxaziridinium functional group upon acceptance of an oxygen atom, especially upon acceptance of an oxygen atom from a peroxyacid and/or salt thereof.

Preferably, the bleach catalyst has a chemical structure corresponding to the following chemical formula:

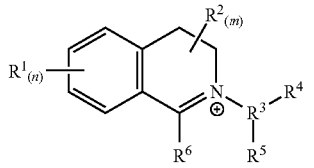

X wherein: n and m are independently from 0 to 4, preferably n and m are both 0; each $R^1$ is independently selected from a substituted or unsubstituted radical selected from the group consisting of hydrogen, alkyl, cycloalkyl, aryl, fused aryl, heterocyclic ring, fused heterocyclic ring, nitro, halo, cyano, sulphonato, alkoxy, keto, carboxylic, and carboalkoxy radicals; and any two vicinal $R^1$ substituents may combine to form a fused aryl, fused carbocyclic or fused heterocyclic ring; each $R^2$ is independently selected from a substituted or unsubstituted radical independently selected from the group consisting of hydrogen, hydroxy, alkyl, cycloalkyl, alkaryl, aryl, aralkyl, alkylenes, heterocyclic ring, alkoxys, arylcarbonyl groups, carboxyalkyl groups and amide groups; any $R^2$ may be joined together with any other of $R^2$ to form part of a common ring; any geminal $R^2$ may combine to form a carbonyl; and any two $R^2$ may combine to form a substituted or unsubstituted fused unsaturated moiety; $R^3$ is a $C_1$ to $C_{20}$ substituted or unsubstituted alkyl; $R^4$ is hydrogen or the moiety $Q_t$-A, wherein: Q is a branched or unbranched alkylene, t=0 or 1 and A is an anionic group selected from the group consisting of $OSO_3^-$, $SO_3^-$, $CO_2^-$, $OCO_2^-$, $OPO_3^{2-}$, $OPO_3H^-$ and $OPO_2^-$; $R^5$ is hydrogen or the moiety —$CR^{11}R^{12}$—Y-$G_b$-$Y_c$— $[(CR^9R^{10})_y$—O$]_k$—$R^8$, wherein: each Y is independently selected from the group consisting of O, S, N—H, or N—$R^8$; and each $R^8$ is independently selected from the group consisting of alkyl, aryl and heteroaryl, said moieties being substituted or unsubstituted, and whether substituted or unsubsituted said moieties having less than 21 carbons; each G is independently selected from the group consisting of CO, $SO_2$, SO, PO and $PO_2$; $R^9$ and $R^{10}$ are independently selected from the group consisting of H and $C_1$-$C_4$ alkyl; $R^{11}$ and $R^{12}$ are independently selected from the group consisting of H and alkyl, or when taken together may join to form a carbonyl; b=0 or 1; c can=0 or 1, but c must=0 if b=0; y is an integer from 1 to 6; k is an integer from 0 to 20; $R^6$ is H, or an alkyl, aryl or heteroaryl moiety; said moieties being substituted or unsubstituted; and X, if present, is a suitable charge balancing counterion, preferably X is present when $R^4$ is hydrogen, suitable X, include but are not limited to: chloride, bromide, sulphate, methosulphate, sulphonate, p-toluenesulphonate, borontetraflouride and phosphate.

In one embodiment of the present invention, the laundry detergent composition comprises a bleach catalyst having a structure corresponding to general formula below:

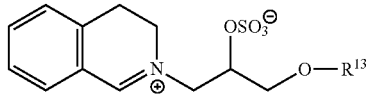

wherein $R^{13}$ is a branched alkyl group containing from three to 24 carbon atoms (including the branching carbon atoms) or a linear alkyl group containing from one to 24 carbon atoms; preferably $R^{13}$ is a branched alkyl group containing from eight to 18 carbon atoms or linear alkyl group containing from eight to eighteen carbon atoms; preferably $R^{13}$ is selected from the group consisting of 2-ethylhexyl, 2-propylheptyl, 2-butyloctyl, 2-pentylnonyl, 2-hexyldecyl, n-dodecyl, n-tetradecyl, n-hexadecyl, n-octadecyl, iso-nonyl, iso-decyl, iso-tridecyl and iso-pentadecyl; preferably $R^{13}$ is selected from the group consisting of 2-butyloctyl, 2-pentylnonyl, 2-hexyldecyl, iso-tridecyl and iso-pentadecyl.

In another embodiment of the present invention, the bleach catalyst has a structure corresponding to general formula below or mixtures thereof.

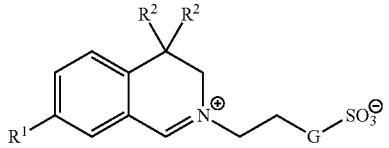

wherein: G is selected from —O—, —$CH_2$O—, —$(CH_2)_2$—, and —$CH_2$—. $R^1$ is selected from H or $C_1$-$C_4$ alkyl. Suitable $C_1$-$C_4$ alkyl moieties include, but are not limited to methyl, ethyl, iso-propyl, and tert-butyl. Each $R^2$ is independently selected from $C_4$-$C_8$ alkyl, benzyl, 2-methylbenzyl, 3-methylbenzyl, 4-methylbenzyl, 4-ethylbenzyl, 4-iso-propylbenzyl and 4-tert-butylbenzyl. Suitable $C_4$-$C_8$ alkyl moieties include, but are not limited to n-butyl, n-pentyl, cyclopentyl, n-hexyl, cyclohexyl, cyclohexylmethyl, n-heptyl and octyl.

In one aspect of the invention G is selected from —O— and —$CH_2$—. $R^1$ is selected from H, methyl, ethyl, iso-propyl, and tert-butyl. Each $R^2$ is independently selected from $C_4$-$C_6$ alkyl, benzyl, 2-methylbenzyl, 3-methylbenzyl, and 4-methylbenzyl.

In another aspect of the invention G is —$CH_2$—, $R^1$ is H and each $R^2$ is independently selected from n-butyl, n-pentyl, n-hexyl, benzyl, 2-methylbenzyl, 3-methylbenzyl, and 4-methylbenzyl.

Method of Determining $LogP_{o/w}$

Log $P_{o/w}$ is determined according to the method found in Brooke, D. N., Dobbs, A. J., Williams, N, *Ecotoxicology and Environmental Safety* (1986) 11(3): 251-260.

Method of Determining Xso

The parameter Xso is determined according to the method described in Adam, W., Haas, W., Lohray, B. B. *Journal of the American Chemical Society* (1991) 113(16) 6202-6208.

Transition Metal Bleach Catalyst

Preferably, the laundry detergent composition comprises a transition metal catalyst. Preferably, the transition metal catalyst may be encapsulated. The transition metal bleach catalyst typically comprises a transition metal ion, preferably selected from transition metal selected from the group consisting of Mn(II), Mn(III), Mn(IV), Mn(V), Fe(II), Fe(III), Fe(IV), Co(I), Co(II), Co(III), Ni(I), Ni(II), Ni(III), Cu(I), Cu(II), Cu(III), Cr(II), Cr(III), Cr(IV), Cr(V), Cr(VI), V(III), V(IV), V(V), Mo(IV), Mo(V), Mo(VI), W(IV), W(V), W(VI), Pd(II), Ru(II), Ru(III), and Ru(IV), more preferably Mn(II), Mn(III), Mn(IV), Fe(II), Fe(III), Cr(II), Cr(III), Cr(IV), Cr(V), and Cr(VI).

The transition metal bleach catalyst typically comprises a ligand, preferably a macropolycyclic ligand, more preferably a cross-bridged macropolycyclic ligand. The transition metal ion is preferably coordinated with the ligand. Preferably, the ligand comprises at least four donor atoms, at least two of which are bridgehead donor atoms.

Preferably, the cross-bridged macropolycyclic ligand is coordinated by four or five donor atoms to the same transition metal and comprises:

(i) an organic macrocycle ring containing four or more donor atoms selected from N and optionally O and S, at least two of these donor atoms being N (preferably at least 3, more preferably at least 4, of these donor atoms are N), separated from each other by covalent linkages of 2 or 3 non-donor atoms, two to five (preferably three to four, more preferably four) of these donor atoms being coordinated to the same transition metal in the complex;

(ii) a cross-bridging chain which covalently connects at least 2 non-adjacent N donor atoms of the organic macrocycle ring, said covalently connected non-adjacent N donor atoms being bridgehead N donor atoms which are coordinated to the same transition metal in the complex, and wherein said cross-bridged chain comprises from 2 to about 10 atoms (preferably the cross-bridged chain is selected from 2, 3 or 4 non-donor atoms, and 4-6 non-donor atoms with a further, preferably N, donor atom); and (iii) optionally, one or more non-macropolycyclic ligands, preferably selected from the group consisting of $H_2O$, ROH, $NR_3$, RCN, $OH^-$, $OOH^-$, $RS^-$, $RO^-$, $RCOO^-$, $OCN^-$, $SCN^-$, $N_3^-$, $CN^-$, $F^-$, $Cl^-$, $Br^-$, $I^-$, $O_2^-$, $NO_3^-$, $NO_2^-$, $SO_4^{2-}$, $SO_3^{2-}$, $PO_4^{3-}$, organic phosphates, organic phosphonates, organic sulfates, organic sulfonates, and aromatic N donors such as pyridines, pyrazines, pyrazoles, imidazoles, benzimidazoles, pyrimidines, triazoles and thiazoles with R being H, optionally substituted alkyl, optionally substituted aryl.

A suitable transition metal bleach catalyst comprises a complex of a transition metal and a macropolycyclic rigid ligand, preferably a cross-bridged macropolycyclic ligand, wherein:

(1) said transition metal is selected from the group consisting of Mn(II), Mn(III), Mn(IV), Mn(V), Fe(II), Fe(III), Fe(IV), Co(I), Co(II), Co(III), Ni(I), Ni(II), Ni(III), Cu(I), Cu(II), Cu(III), Cr(II), Cr(III), Cr(IV), Cr(V), Cr(VI), V(III), V(IV), V(V), Mo(IV), Mo(V), Mo(VI), W(IV), W(V), W(VI), Pd(II), Ru(II), Ru(III), and Ru(IV); and (2) said macropolycyclic rigid ligand is coordinated by at least four, preferably four or five, donor atoms to the same transition metal and comprises:

(i) an organic macrocycle ring containing four or more donor atoms (preferably at least 3, more preferably at least 4, of these donor atoms are N) separated from each other by covalent linkages of at least one, preferably 2 or 3, non-donor atoms, two to five (preferably three to four, more preferably four) of these donor atoms being coordinated to the same transition metal in the complex;

(ii) a linking moiety, preferably a cross-bridging chain, which covalently connects at least 2 (preferably non-adjacent) donor atoms of the organic macrocycle ring, said covalently connected (preferably non-adjacent) donor atoms being bridgehead donor atoms which are coordinated to the same transition metal in the complex, and wherein said linking moiety (preferably a cross-bridged chain) comprises from 2 to about 10 atoms (preferably the cross-bridged chain is selected from 2, 3 or 4 non-donor atoms, and 4-6 non-donor atoms with a further donor atom), including for example, a cross-bridge which is the result of a Mannich condensation of ammonia and formaldehyde; and (iii) optionally, one or more non-macropolycyclic ligands, preferably monodentate ligands, such as those selected from the group consisting of $H_2O$, ROH, $NR_3$, RCN, $OH^-$, $OOH^-$, $RS^-$, $RO^-$, $RCOO^-$, $OCN^-$, $SCN^-$, $N_3^-$, $CN^-$, $F^-$, $Cl^-$, $Br^-$, $I^-$, $O_2^-$, $NO_3^-$, $NO_2^-$, $SO_4^{2-}$, $SO_3^{2-}$, $PO_4^{3-}$, organic phosphates, organic phosphonates, organic sulfates, organic sulfonates, and aromatic N donors such as pyridines, pyrazines, pyrazoles, imidazoles, benzimidazoles, pyrimidines, triazoles and thiazoles with R being H, optionally substituted alkyl, optionally substituted aryl (specific examples of monodentate ligands including phenolate, acetate or the like).

Suitable cross-bridged macropolycyclic ligands include:

(i) the cross-bridged macropolycyclic ligand of formula (I) having denticity of 4 or 5:

(I)

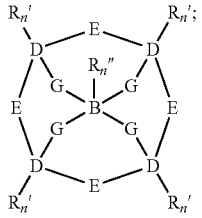

(ii) the cross-bridged macropolycyclic ligand of formula (II) having denticity of 5 or 6:

(II)

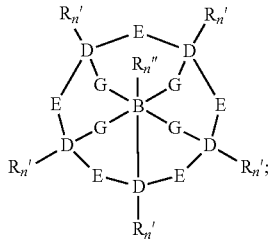

(iii) the cross-bridged macropolycyclic ligand of formula (III) having denticity of 6 or 7:

(III)

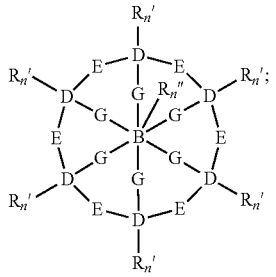

wherein in these formulas:

each "E" is the moiety $(CR_n)_a$—X—$(CR_n)_{a'}$, wherein —X— is selected from the group consisting of O, S, NR and P, or a covalent bond, and preferably X is a covalent bond and for each E the sum of a+a' is independently selected from 1 to 5, more preferably 2 and 3;

each "G" is the moiety $(CR_n)_b$;

each "R" is independently selected from H, alkyl, alkenyl, alkynyl, aryl, alkylaryl (e.g., benzyl), and heteroaryl, or two or more R are covalently bonded to form an aromatic, heteroaromatic, cycloalkyl, or heterocycloalkyl ring;

each "D" is a donor atom independently selected from the group consisting of N, O, S, and P, and at least two D atoms are bridgehead donor atoms coordinated to the transition metal (in the preferred embodiments, all donor atoms designated D are donor atoms which coordinate to the transition metal, in contrast with heteroatoms in the structure which are not in D such as those which may be present in E; the non-D heteroatoms can be non-coordinating and indeed are non-coordinating whenever present in the preferred embodiment);

"B" is a carbon atom or "D" donor atom, or a cycloalkyl or heterocyclic ring;

each "n" is an integer independently selected from 1 and 2, completing the valence of the carbon atoms to which the R moieties are covalently bonded;

each "n'" is an integer independently selected from 0 and 1, completing the valence of the D donor atoms to which the R moieties are covalently bonded;

each "n"" is an integer independently selected from 0, 1, and 2 completing the valence of the B atoms to which the R moieties are covalently bonded;

each "a" and "a'" is an integer independently selected from 0-5, preferably a+a' equals 2 or 3, wherein the sum of all "a" plus "a'" in the ligand of formula (I) is within the range of from about 6 (preferably 8) to about 12, the sum of all "a" plus "a'" in the ligand of formula (II) is within the range of from about 8 (preferably 10) to about 15, and the sum of all "a" plus "a'" in the ligand of formula (III) is within the range of from about 10 (preferably 12) to about 18;

each "b" is an integer independently selected from 0-9, preferably 0-5 (wherein when b=0, $(CR_n)_0$ represents a covalent bond), or in any of the above formulas, one or more of the $(CR_n)_b$ moieties covalently bonded from any D to the B atom is absent as long as at least two $(CR_n)_b$ covalently bond two of the D donor atoms to the B atom in the formula, and the sum of all "b" is within the range of from about 1 to about 5.

A suitable cross-bridged macropolycyclic ligand is selected from the group consisting of:

(I)

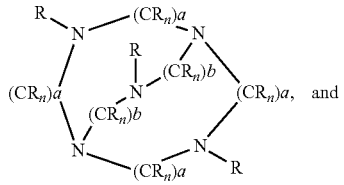

(II)

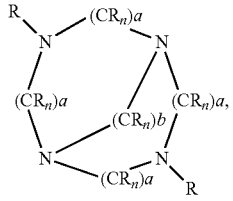

wherein in these formulas:

each "R" is independently selected from H, alkyl, alkenyl, alkynyl, aryl, alkylaryl (e.g., benzyl) and heteroaryl, or two or more R are covalently bonded to form an aromatic, heteroaromatic, cycloalkyl, or heterocycloalkyl ring;

each "n" is an integer independently selected from 0, 1 and 2, completing the valence of the carbon atoms to which the R moieties are covalently bonded;

each "b" is an integer independently selected from 2 and 3; and each "a" is an integer independently selected from 2 and 3.

Suitable transition metal bleach catalysts include: Dichloro-5,12-dimethyl-1,5,8,12-tetraazabicyclo[6.6.2]hexadecane Manganese(II); Dichloro-4,10-dimethyl-1,4,7,10-tetraazabicyclo[5.5.2]tetradecane Manganese(II); Diaquo-5,12-dimethyl-1,5,8,12-tetraazabicyclo[6.6.2]hexadecane Manganese (II) Hexafluorophosphate; Aquo-hydroxy-5,12-dimethyl-1,5,8,12-tetraazabicyclo[6.6.2]hexadecane Manganese(III) Hexafluorophosphate; Diaquo-4,10-dimethyl-1,4,7,10-tetraazabicyclo[5.5.2]tetradecane Manganese(II) Hexafluorophosphate; Diaquo-5,12-dimethyl-1,5,8,12-tetraazabicyclo[6.6.2]hexadecane Manganese(II) Tetrafluoroborate; Diaquo-4,10-dimethyl-1,4,7,10-tetraazabicyclo[5.5.2]tetradecane Manganese(II) Tetrafluoroborate; Dichloro-5,12-dimethyl-1,5,8,12-tetraazabicyclo[6.6.2]hexadecane Manganese(III); Hexafluorophosphate; Dichloro-5,12-di-n-butyl-1,5,8,12-tetraaza-bicyclo[6.6.2]hexadecane Manganese(II); Dichloro-5,12-dibenzyl-1,5,8,12-tetraazabicyclo[6.6.2]hexadecane Manganese(II); Dichloro-5-n-butyl-12-methyl-1,5,8,12-tetraaza-bicyclo[6.6.2]hexadecane Manganese(II); Dichloro-5-n-octyl-12-methyl-1,5,8,12-tetraaza-bicyclo[6.6.2]hexadecane Manganese(II); Dichloro-5-n-butyl-12-methyl-1,5,8,12-tetraaza-bicyclo[6.6.2]hexadecane Manganese(II); Dichloro-5,12-dimethyl-1,5,8,12-tetraazabicyclo[6.6.2]hexadecane Iron(II); Dichloro-4,10-dimethyl-1,4,7,10-tetraazabicyclo[5.5.2]tetradecane Iron (II); Dichloro-5,12-dimethyl-1,5,8,12-tetraazabicyclo[6.6.2]hexadecane Copper(II); Dichloro-4,10-dimethyl-1,4,7,10-tetraazabicyclo[5.5.2]tetradecane Copper(II); Dichloro-5,12-dimethyl-1,5,8,12-tetraazabicyclo[6.6.2]hexadecane Cobalt(II); Dichloro-4,10-dimethyl-1,4,7,10-tetraazabicyclo[5.5.2]tetradecane Cobalt(II); Dichloro 5,12-dimethyl-4-phenyl-1,5,8,12-tetraazabicyclo[6.6.2]hexadecane Manganese(II); Dichloro-4,10-dimethyl-3-phenyl-1,4,7,10-tetraazabicyclo[5.5.2]tetradecane Manganese(II); Dichloro-5,12-dimethyl-4,9-diphenyl-1,5,8,12-tetraazabicyclo[6.6.2]hexadecane Manganese(II); Dichloro-4,10-dimethyl-3,8-diphenyl-1,4,7,10-tetraazabicyclo[5.5.2]tetradecane Manganese(II); Dichloro-5,12-dimethyl-2,11-diphenyl-1,5,8,12-tetraazabicyclo[6.6.2]hexadecane Manganese(II); Dichloro-4,10-dimethyl-4,9-diphenyl-1,4,7,10-tetraazabicyclo[5.5.2]tetradecane Manganese(II); Dichloro-2,4,5,9,11,12-hexamethyl-1,5,8,12-tetraazabicyclo[6.6.2]hexadecane Manganese(II); Dichloro-2,3,5,9,10,12-hexamethyl-1,5,8,12-tetraazabicyclo[6.6.2]hexadecane Manganese(II); Dichloro-2,2,4,5,9,9,11,12-octamethyl-1,5,8,12-tetraazabicyclo[6.6.2]hexadecane Manganese(II); Dichloro-2,2,4,5,9,11,11,12-octamethyl-1,5,8,12-tetraazabicyclo[6.6.2]hexadecane Manganese(II); Dichloro-3,3,5,10,10,12-hexamethyl-1,5,8,12-tetraazabicyclo[6.6.2]hexadecane Manganese(II); Dichloro-3,5,10,12-tetramethyl-1,5,8,12-tetraazabicyclo[6.6.2]hexadecane Manganese(II); Dichloro-3-butyl-5,10,12-trimethyl-1,5,8,12-tetraazabicyclo[6.6.2]hexadecane Manganese(II); Dichloro-1,5,8,12-tetraazabicyclo[6.6.2]hexadecane Manganese(II); Dichloro-1,4,7,10-tetraazabicyclo[5.5.2]tetradecane Manganese(II); Dichloro-1,5,8,12-tetraazabicyclo[6.6.2]hexadecane Iron (II); Dichloro-1,4,7,10-tetraazabicyclo[5.5.2]tetradecane Iron(II); Aquo-chloro-2-(2-hydroxyphenyl)-5,12-dimethyl,5,8,12-tetraazabicyclo[6.6.2]hexadecane Manganese(II); Aquo-chloro-10-(2-hydroxybenzyl)-4,10-dimethyl-1,4,7,10-tetraazabicyclo[5.5.2]tetradecane Manganese(II); Chloro-2-(2-hydroxybenzyl)-5-methyl,5,8,12-tetraazabicyclo[6.6.2]hexadecane Manganese(II); Chloro-10-(2-hydroxybenzyl)-4-methyl-1,4,7,10-tetraazabicyclo[5.5.2]tetradecane Manganese(II); Chloro-5-methyl-12-(2-picolyl)-1,5,8,12-tetraazabicyclo[6.6.2]hexadecane Manganese(II) Chloride; Chloro-4-methyl-10-(2-picolyl)-1,4,7,10-tetraazabicyclo[5.5.21]tetradecane Manganese(II) Chloride; Dichloro-5-(2-sulfato)dodecyl-12-methyl-1,5,8,12-tetraazabicyclo[6.6.2]hexadecane Manganese(III); Aquo-Chloro-5-(2-sulfato)dodecyl-12-methyl-1,5,8,12-tetraazabicyclo[6.6.2]hexadecane Manganese(II); Aquo-Chloro-5-(3-sulfonopropyl)-12-methyl-1,5,8,12-tetraazabicyclo[6.6.2]hexadecane Manganese(II); Dichloro-5-(Trimethylammoniopropyl)dodecyl-12-methyl-1,5,8,12-tetraazabicyclo[6.6.2]hexadecane Manganese(III) Chloride; Dichloro-5,12-dimethyl-1,4,7,10,13-pentaazabicyclo[8.5.2]heptadecane Manganese(II); Dichloro-14,20-dimethyl-1,10,14,20-tetraazatriyclo[8.6.6]docosa-3(8),4,6-triene Manganese(II); Dichloro-4,11-dimethyl-1,4,7,11-tetraazabicyclo[6.5.2]pentadecane Manganese(II); Dichloro-5,12-dimethyl-1,5,8,12-tetraazabicyclo[7.6.2]heptadecane Manganese(II); Dichloro-5,13-dimethyl-1,5,9,13-tetraazabicyclo[7.7.2]heptadecane Manganese(II); Dichloro-3,10-bis(butylcarboxy)-5,12-dimethyl-1,5,8,12-tetraazabicyclo[6.6.2]hexadecane Manganese(II); Diaquo-3,10-dicarboxy-5,12-dimethyl-1,5,8,12-tetraazabicyclo[6.6.2]hexadecane Manganese(II); Chloro-20-methyl-1,9,20,24,25-pentaaza-tetracyclo[7.7.7.1$^{3,7}$.1$^{11,15}$.]pentacosa-3,5,7 (24),11,13,15(25)-hexaene manganese(II) Hexafluorophosphate; Trifluoromethanesulfono-20-methyl-1,9,20,24,25-pentaaza-tetracyclo[7.7.7.1$^{3,7}$.1$^{11,15}$.]pentacosa-3,5,7(24),11,13,15 (25)-hexaene Manganese(II) Trifluoromethanesulfonate; Trifluoromethanesulfono-20-methyl-1,9,20,24,25-pentaaza-tetracyclo[7.7.7.1$^{3,7}$.1$^{11,15}$.]pentacosa-3,5,7(24),11,13,15 (25)-hexaene Iron(II) Trifluoromethanesulfonate; Chloro-5,12,17-trimethyl-1,5,8,12,17-pentaazabicyclo[6.6.5]nonadecane Manganese(II) Hexafluorophosphate; Chloro-4,10,15-trimethyl-1,4,7,10,15-pentaazabicyclo[5.5.5]heptadecane Manganese(II) Hexafluorophosphate; Chloro-5,12,17-trimethyl-1,5,8,12,17-pentaazabicyclo[6.6.5]nonadecane Manganese(II) Chloride; Chloro-4,10,15-trimethyl-1,4,7,10,15-pentaazabicyclo[5.5.5]heptadecane Manganese(II) Chloride; Dichloro-5,12-diethyl-1,5,8,12-tetraazabicyclo[6.6.2]hexadecanemanganese; and any mixture thereof.

Other suitable transition metal bleach catalysts are described in U.S. Pat. No. 5,580,485, U.S. Pat. No. 4,430,243; U.S. Pat. No. 4,728,455; U.S. Pat. No. 5,246,621; U.S. Pat. No. 5,244,594; U.S. Pat. No. 5,284,944; U.S. Pat. No. 5,194,416; U.S. Pat. No. 5,246,612; U.S. Pat. No. 5,256,779; U.S. Pat. No. 5,280,117; U.S. Pat. No. 5,274,147; U.S. Pat. No. 5,153,161; U.S. Pat. No. 5,227,084; U.S. Pat. No. 5,114,606; U.S. Pat. No. 5,114,611, EP 549,271 A1; EP 544,490 A1; EP 549,272 A1; and EP 544,440 A2.

A suitable transition metal bleach catalyst is a manganese-based catalyst, for example disclosed in U.S. Pat. No. 5,576,282.

Suitable cobalt bleach catalysts are described, for example, in U.S. Pat. No. 5,597,936 and U.S. Pat. No. 5,595,967. Such cobalt catalysts are readily prepared by known procedures, such as taught for example in U.S. Pat. No. 5,597,936, and U.S. Pat. No. 5,595,967.

A suitable transition metal bleach catalyst is a transition metal complex of ligand such as bispidones described in WO 05/042532 A1.

The inventors have found that transition metal bleach catalysts provide robust cleaning profiles, especially under dilute wash conditions, and especially against beta-carotene, squalene and unsaturated triglyceride soils, and especially at low washing temperatures.

Pre-Formed Peracid

The laundry detergent composition may comprise a pre-formed peracid. The pre-peroxyacid or salt thereof is typically either a peroxycarboxylic acid or salt thereof, or a peroxysulphonic acid or salt thereof.

The pre-formed peroxyacid or salt thereof is preferably a peroxycarboxylic acid or salt thereof, typically having a chemical structure corresponding to the following chemical formula:

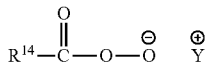

wherein: $R^{14}$ is selected from alkyl, aralkyl, cycloalkyl, aryl or heterocyclic groups; the $R^{14}$ group can be linear or branched, substituted or unsubstituted; and Y is any suitable counter-ion that achieves electric charge neutrality, preferably Y is selected from hydrogen, sodium or potassium. Preferably, $R^{14}$ is a linear or branched, substituted or unsubstituted $C_{6-9}$ alkyl. Preferably, the peroxyacid or salt thereof is selected from peroxyhexanoic acid, peroxyheptanoic acid, peroxyoctanoic acid, peroxynonanoic acid, peroxydecanoic acid, any salt thereof, or any combination thereof. Preferably, the peroxyacid or salt thereof has a melting point in the range of from 30° C. to 60° C.

The pre-formed peroxyacid or salt thereof can also be a peroxysulphonic acid or salt thereof, typically having a chemical structure corresponding to the following chemical formula:

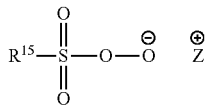

wherein: $R^{15}$ is selected from alkyl, aralkyl, cycloalkyl, aryl or heterocyclic groups; the $R^{15}$ group can be linear or branched, substituted or unsubstituted; and Z is any suitable counter-ion that achieves electric charge neutrality, preferably Z is selected from hydrogen, sodium or potassium. Preferably $R^{15}$ is a linear or branched, substituted or unsubstituted $C_{6-9}$ alkyl.

The pre-formed peroxyacid or salt thereof may be in an encapsulated, preferably molecularly encapsulated, form. Typically, the pre-formed peroxyacid molecules are individually separated from each other by any suitable molecular encapsulation means.

Preferably, the pre-formed peroxyacid is a guest molecule in a host-guest complex. Typically, the host molecule of the host-guest complex comprises, or is capable of forming (e.g. by their intermolecular configuration), a cavity into which the pre-formed peroxyacid molecule can be located. The host molecule is typically in the form of a relatively open structure which provides a cavity that may be occupied by a pre-formed peroxyacid molecule: thus forming the host-guest complex. The pre-formed peroxyacid molecule may become entrapped by one or more host molecules, for example by the formation of a clathrate compound, also typically known as inclusion compound, cage compound, molecular compound, intercalation compound or adduct.

The host molecule is typically capable of forming hydrogen bonds: such as intramolecular hydrogen bonds or intermolecular hydrogen bonds. Preferably, the host molecule is capable of forming intermolecular hydrogen bonds.

Suitable host molecules include: urea; cyclodextrins, particularly beta-cyclodextrins; thiourea; hydroquinone; perhydrotriphenylene; deoxycholic acid; triphenylcarbinol; calixarene; zeolites, particularly wide-pore zeolites; and any combination thereof. The host molecules are most preferably water-soluble; this is desirable so as to enable the effective release and dispersion of the pre-formed peroxyacid on introduction of the host-guest complex into an aqueous environment, such as a wash liquor. Preferably, the host molecule is urea or thiourea, especially preferably the host molecule is urea.

The host-guest complex is preferably at least partially, preferably essentially completely, coated by a coating ingredient; this is desirable so as to further improve the stability of the pre-formed peroxyacid. Typically, the coating ingredient is essentially incapable of forming hydrogen bonds; this helps ensure the optimal intermolecular configuration of the host molecules, especially when the host-guest complex is a clathrate compound, and further improves the stability of the pre-formed peroxyacid. Typically, the coating ingredient is chemically compatible with the host-guest complex and has a suitable release profile, especially an appropriate melting point range: the melting point range of the coating ingredient is preferably from 35° C. to 60° C., more preferably from 40° C. to 50° C., or from 46° C. to 68° C. Suitable coating ingredients include paraffin waxes, semi-microcrystalline waxes (also typically known as intermediate-microcrystalline waxes), microcrystalline waxes and natural waxes. Preferred paraffin waxes include: Merck® 7150 and Merck® 7151 supplied by E. Merck of Darmstadt, Germany; Boler® 1397, Boler® 1538 and Boler® 1092 supplied by Boler of Wayne, Pa.; Ross® fully refined paraffin wax 115/120 supplied by Frank D. Ross Co., Inc of Jersey City, N.J.; Tholler® 1397 and Tholler®1538 supplied by Tholler of Wayne, Pa.; Paramelt® 4608 supplied by Terhell Paraffin of Hamburg, Germany and Paraffin® R7214 supplied by Moore & Munger of Shelton, Conn. Preferred paraffin waxes typically have a melting point in the range of from 46° C. to 68° C., and they typically have a number average molecular weight in the range of from 350 Da to 420 Da. Also suitable are: natural waxes, such as natural bayberry wax, having a melting point in the range of from 42° C. to 48° C. supplied by Frank D. Ross Co., Inc.; synthetic substitutes of natural waxes, such as synthetic spermaceti wax, having a melting point in the range of from 42° C. to 50° C., supplied by Frank D. Ross Co., Inc., synthetic beeswax (BD4) and glyceryl behenate (HRC) synthetic wax. Other suitable coating ingredients include fatty acids, especially hydrogenated fatty acids. However, most preferably the coating ingredient is a paraffin wax.

Typically, the host-guest complex is in an intimate mixture with a source of acid. Typically, the host-guest complex and the source of acid are in particulate form, preferably being in a co-particulate mixture with each other: typically both are present in the same particle. Preferred sources of acid include: fatty acids, especially hydrogenated fatty acids, which may also be suitable coating ingredients and are described above; carboxylic acids, including mono-carboxylic acids, and polycarboxylic acids such as di-carboxylic acids and tri-carboxylic acids. Preferably, the source of acid is a bi-carboxylic acid.

It may be preferred for the host-guest complex to be in an intimate mixture with a free radical scavenger. A suitable free radical scavenger is butylated hydroxytoluene.

Without wishing to be bound by theory, the inventors believe that the pre-formed peracid's has the ability to bleach even in the absence of an alkalinity source or hydrogen peroxide. The pre-formed peracid is not susceptible to the effects of catalase. This means that on a weight basis, the pre-formed peracid provides a good bleaching performance as one compacts the alkalinity/buffer systems and the wash liquor pH decreases.

Source of Hydrogen Peroxide

The composition preferably comprises a source of hydrogen peroxide, preferably from above 0 wt % to 15 wt %, preferably from 1 wt %, or from 2 wt %, or from 3 wt %, or from 4 wt %, or from 5 wt %, and preferably to 12 wt %, or preferably from 0 wt % to 10 wt % source of hydrogen peroxide. Preferably, the source of hydrogen peroxide is coated, preferred coatings include sulphate salts, silicate salts, carbonate salts, burkeite, borosilicate, and any mixture thereof including any double salt thereof. Preferably, the wash liquor comprises from above 0 g/l to 0.5 g/l hydrogen peroxide, preferably from 0.01 g/l, and preferably to 0.4 g/l, or even to 0.3 g/l, or even to 0.2 g/l, or even to 0.1 g/l. Preferably, the laundry detergent composition comprises a source of hydrogen peroxide in an amount such that during the method of the present invention from above 0 g to 1.5 g, or to 1.0 g, or to 0.8 g, or to 0.6 g, or to 0.5 g, or to 0.4 g source of hydrogen peroxide per liter of water is contacted to said water when forming the wash liquor.

Typically, the source of hydrogen peroxide comprises from 10% to 100%, by weight of the source of hydrogen peroxide, of hydrogen peroxide.

Preferred sources of hydrogen peroxide include sodium perborate in, preferably in mono-hydrate or tetra-hydrate form or mixtures thereof, sodium percarbonate. Especially preferred is sodium percarbonate. The sodium percarbonate can be in the form of a coated percarbonate particle, the particle being a physically separate and discrete particle from the other particles of the laundry detergent composition, and especially from any bleach activator or the bleach ingredient. Alternatively, the percarbonate can be in the form of a co-particle that additionally comprises a bleach activator such as tetra-ethylene diamine (TAED) and the bleach ingredient. Highly preferred, when a co-particle form is used, a bleach activator at least partially, preferably completely, encloses the source of hydrogen peroxide.

Bleach Activator

Preferably, the composition comprises a bleach activator. Suitable bleach activators are compounds which when used in conjunction with a hydrogen peroxide source leads to the in situ production of the peracid corresponding to the bleach activator. Various non limiting examples of bleach activators are disclosed in U.S. Pat. No. 4,915,854, issued Apr. 10, 1990 to Mao et al, and U.S. Pat. No. 4,412,934. The nonanoyloxybenzene sulfonate (NOBS) and tetraacetylethylenediamine (TAED) activators are typical, and mixtures thereof can also be used. See also U.S. Pat. No. 4,634,551 for other typical bleaches and activators useful herein. Another suitable bleach activator is decanoyloxybenzenecarboxylic acid (DOBA).

Highly preferred amido-derived bleach activators are those of the formulae:

$$R^1N(R^5)C(O)R^2C(O)L$$

or $$R^1C(O)N(R^5)R^2C(O)L$$

wherein as used for these compounds $R^1$ is an alkyl group containing from about 6 to about 12 carbon atoms, $R^2$ is an alkylene containing from 1 to about 6 carbon atoms, $R^5$ is H or alkyl, aryl, or alkaryl containing from about 1 to about 10 carbon atoms, and L is any suitable leaving group. A leaving group is any group that is displaced from the bleach activator as a consequence of the nucleophilic attack on the bleach activator by the hydroperoxide anion. A preferred leaving group is oxybenzenesulfonate.

Preferred examples of bleach activators of the above formulae include (6-octanamido-caproyl)oxybenzenesulfonate, (6-nonanamidocaproyl)oxybenzenesulfonate, (6-decanamido-caproyl)oxybenzenesulfonate, and mixtures thereof as described in U.S. Pat. No. 4,634,551, incorporated herein by reference.

Another class of bleach activators comprises the benzoxazin-type activators disclosed by Hodge et al in U.S. Pat. No. 4,966,723, issued Oct. 30, 1990, incorporated herein by reference. A highly preferred activator of the benzoxazin-type is:

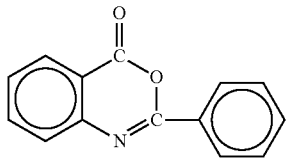

Still another class of preferred bleach activators includes the acyl lactam activators, especially acyl caprolactams and acyl valerolactams of the formulae:

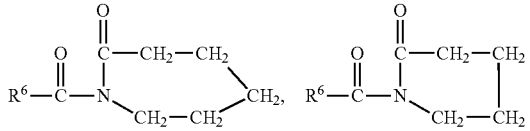

wherein as used for these compounds $R^6$ is H or an alkyl, aryl, alkoxyaryl, or alkaryl group containing from 1 to about 12 carbon atoms. Highly preferred lactam activators include benzoyl caprolactam, octanoyl caprolactam, 3,5,5-trimethylhexanoyl caprolactam, nonanoyl caprolactam, decanoyl caprolactam, undecenoyl caprolactam, benzoyl valerolactam, octanoyl valerolactam, decanoyl valerolactam, undecenoyl valerolactam, nonanoyl valerolactam, 3,5,5-trimethylhexanoyl valerolactam and mixtures thereof. See also U.S. Pat. No. 4,545,784, issued to Sanderson, Oct. 8, 1985, incorporated herein by reference, which discloses acyl caprolactams, including benzoyl caprolactam, adsorbed into sodium perborate. Highly preferred bleach activators are nonanoyloxybenzene sulfonate (NOBS) and/or tetraacetylethylenediamine (TAED).

It is highly preferred for a large amount of bleach activator relative to the source of hydrogen peroxide to be present in the laundry detergent composition. Preferably, the weight ratio of bleach activator to source of hydrogen peroxide present in the laundry detergent composition is at least 0.5:1, at least 0.6:1, at least 0.7:1, 0.8:1, preferably at least 0.9:1, or 1.0:1.0, or even 1.2:1 or higher.

Layered Particle

In a highly preferred embodiment of the present invention, the laundry detergent composition comprises a layered particle. The layered particle comprises a core and a layer. The core comprises a source of hydrogen peroxide. The layer comprises a binder and a bleach activator. The weight ratio of said source of hydrogen peroxide to said bleach activator present in the layered particle is preferably from about 5:1 to about 1.1:1, or from about 4:1 to about 1.5:1, or about 2:1.

Preferably, the layered particle may have an average diameter of from about 600 μm to 2000 μm, or from about 800 μm to about 1000 μm. In one aspect, the layer may have a thickness of from about 25 μm to about 150 μm, or from about 40 μm to about 100 μm.

Preferably, the binder may comprise, based on total layered particle weight, from about 2% to about 20%, or from about 4% to about 15%, or about 6% to about 10%, or from about 7% to about 8% of said layered particle. The binder may comprise, based on total layered particle weight, from about 0.001% to about 5%, or from about 0.5% to about 3%, or about 1% to about 2% water. In one aspect, the binder may be substantially free of water. In one aspect, the binder may be capable of absorbing from about 0.1% to about 20%, or from about 1% to about 15%, or from about 2% to about 10% water by weight of said binder over a relative humidity of 80% at 32° C. In one aspect, the binder may have a viscosity of from about 200 to about 20,000, or from about 500 to about 7,000, or from about 1,000 to about 2,000 centipoise at a shear rate of 25 $sec^{-1}$ at 25° C.

The binder may comprise, based on total binder weight, from about 40% to 100%, or about 50% to about 99% of a surfactant material selected from the group consisting of anionic surfactant, nonionic surfactant, and combinations thereof, more preferably alcohol ethoxylate and linear alkylbenzene sulfonate. In one aspect, the binder may comprise, based on total binder weight, from about 60% to about 100%, or about 70% to about 90%, of a non-surfactant material comprising a hydrocarbon material selected from the group consisting of fats, triglycerides, lipids, fatty acids, soft paraffin wax, and combinations thereof.

The binder may have a pH of from about 3 to about 9, or from about 5 to about 8, or about 7, as measured as a 10% solution in water. In one aspect, the binder may comprise a solvent.

The layered particle may comprise a dusting powder that may comprise a material selected from the group consisting of silicas; zeolites; amorphous aluminosilicates; clays; starches; celluloses; water soluble salts, such as an inorganic salt selected from the group consisting of, sodium chloride, sodium sulphate, magnesium sulphate, and salts and mixtures thereof; polysaccharides including sugars; and combinations thereof.

The layer may comprise an additive selected from the group consisting of acidic materials, moisture sinks; gelling agents; antioxidants; organic catalysts and combinations thereof.

In one aspect, the additive may comprise an acidic material having a pKa of from about 3 to about 7, or about 5. In one aspect, the acidic material may be ascorbic acid.

In one aspect, the additive may comprise a moisture sink that may be selected from the group consisting of crosslinked polyacrylates; sodium salts of maleic/acrylic copolymers; magnesium sulfate; and combinations thereof.

In one aspect, the additive may comprise a gelling agent that may be selected from the group consisting of a cellulose including methylcellulose and CMC; alginate and derivatives thereof; starches; polyvinyl alcohols; polyethylene oxide; polyvinylpyrolidone; polysaccharides including chitosan and/or natural gums including carrageenan, xantham gum, guar gum, locust bean gum, and combinations thereof; polyacrylates including cross-linked polyacrylates; alcohol ethoxylates; lignosulfonates; surfactants and mixtures thereof; powdered anionic surfactants; and combinations thereof.

In one aspect, the additive may comprise an antioxidant that may be selected from the group consisting of phenolic antioxidants; amine antioxidants; alkylated phenols; hindered phenolic compounds; benzofuran or benzopyran; alpha-tocopherol, beta-tocopherol, gamma-tocopherol, delta-tocopherol, and derivatives thereof; 6-hydroxy-2,5,7,8-tetra-methylchroman-2-carboxylic acid; ascorbic acid and its salts; butylated hydroxy benzoic acids and their salts; gallic acid and its alkyl esters; uric acid and its salts and alkyl esters; sorbic acid and its salts; amines; sulfhydryl compounds; dihydroxy fumaric acid and its salts; and combinations thereof, 2,6-di-tert-butylphenol; 2,6-di-tert-butyl-4-methylphenol; mixtures of 2 and 3-tert-butyl-4-methoxyphenol; propyl gallate; tert-butylhydroquinone; benzoic acid derivatives such as methoxy benzoic acid; methylbenzoic acid; dichloro benzoic acid; dimethyl benzoic acid; 5-hydroxy-2,2,4,6,7-pentamethyl-2,3-dihydro-1-benzofuran-3-one; 5-hydroxy-3-methylene-2,2,4,6,7-pentamethyl-2,3-dihydro-benzofuran; 5-benzyloxy-3-hydroxymethyl-2,2,4,6,7-pentamethyl-2,3-dihydro-1-benzofura-n, 3-hydroxymethyl-5-methoxy-2,2,4,6,7-pentamethyl-2,3-dihydro-1-benzofura-n; ascorbic acid; 1,2-dihydro-6-ethoxy-2,2,4-trimethylchinolin, and combinations thereof; 2,6-di-tert-butyl hydroxy toluene; alpha-tocopherol; hydroquinone, 2,2,4-trimethyl-1,2-dihydroquinoline; 2,6-di-tert-butyl hydroquinone; 2-tert-butyl hydroquinone; tert-butyl-hydroxy anisole; lignosulphonic acid and salts thereof; benzoic acid and derivatives thereof; trimethoxy benzoic acid; toluic acid; catechol; t-butyl catechol; benzylamine; amine alcohols; 1,1,3-tris(2-methyl-4-hydroxy-5-t-butylphenyl) butane; N-propyl-gallate or mixtures thereof; or di-tert-butyl hydroxy toluene.

In one aspect, the additive may comprise an organic catalyst that may be selected from the group consisting of iminium cations and polyions; iminium zwitterions; modified amines; modified amine oxides; N-sulphonyl imines; N-phosphonyl imines; N-acyl imines; thiadiazole dioxides; perfluoroimines; cyclic sugar ketones; and combinations thereof; or an organic catalyst selected from the group consisting of 2-[3-[(2-hexyldodecyl)oxy]-2-(sulfooxy)propyl]-3,4-dihydroisoquinolinium, inner salt; 3,4-dihydro-2-[3-[(2-pentylundecyl)oxy]-2-(sulfooxy)propyllisoquinolinium, inner salt; 2-[3-[(2-butyldecyl)oxy]-2-(sulfooxy)propyl]-3,4-dihydroisoquinolinium, inner salt; 3,4-dihydro-2-[3-(octadecyloxy)-2-(sulfooxy)propyl]isoquinolinium, inner salt; 2-[3-(hexadecyloxy)-2-(sulfooxy)propyl]-3,4-dihydroisoquinolinium, inner salt; 3,4-dihydro-2-[2-(sulfooxy)-3-(tetradecyloxy)propyl]isoquinolinium, inner salt; 2-[3-(dodecyloxy)-2-(sulfooxy)propyl]3,4-dihydroisoquinolinium, inner salt; 2-[3-[(3-hexyldecyl)oxy]-2-(sulfooxy)propyl]-3,4-dihydroisoquinolinium, inner salt; 3,4-dihydro-2-[3-[(2-pentylnonyl)oxy]-2-(sulfooxy)propyl]isoquinolinium, inner salt; 3,4-dihydro-2-[3-[(2-propylheptyl)oxy]-2-(sulfooxy)propyl]isoquinolinium, inner salt; 2-[3-[(2-butyloctyl)oxy]-2-(sulfooxy)propyl]-3,4-dihydroisoquinolinium, inner salt; 2-[3-(decyloxy)-2-(sulfooxy)propyl]-3,4-dihydroisoquinolinium, inner salt; 3,4-dihydro-2-[3-(octyloxy)-2-(sulfooxy)propyl]isoquinolinium, inner salt; 2-[3-[(2-ethylhexyl)oxy]-2-(sulfooxy)propyl]-3,4-dihydroisoquinolinium, inner salt or mixtures thereof; or 2-[3-[(2-butyloctyl)oxy]-2-(sulfooxy)propyl]-3,4-dihydroisoquinolinium, inner salt.

In one aspect, the layered particle may be substantially free of fatty acids, fatty acid polyol esters, polyglycols, and fatty alcohol oxalkylates.

Chelant

The composition may comprise a chelant. Suitable chelants include diethylene triamine pentaacetate, diethylene triamine penta(methyl phosphonic acid), ethylene diamine-N'N'-disuccinic acid, ethylene diamine tetraacetate, ethylene diamine tetra(methylene phosphonic acid) and hydroxyethane di(methylene phosphonic acid). A preferred chelant is ethylene diamine-N'N'-disuccinic acid (EDDS) and/or hydroxyethane diphosphonic acid (HEDP). The laundry detergent composition preferably comprises ethylene diamine-N'N'-disuccinic acid or salt thereof. Preferably the ethylene diamine-N'N'-disuccinic acid is in S'S' enantiomeric form. Preferably the composition comprises 4,5-dihydroxy-m-benzenedisulfonic acid disodium salt.

Fabric Hueing Agent

Suitable fabric hueing agents include dyes, dye-clay conjugates, and pigments that preferably satisfy the requirements of Test Method 1, described herein below. Suitable dyes include small molecule dyes and polymeric dyes. Suitable small molecule dyes include small molecule dyes selected from the group consisting of dyes falling into the Colour Index (C.I.) classifications of Direct Blue, Direct Red, Direct Violet, Acid Blue, Acid Red, Acid Violet, Basic Blue, Basic Violet and Basic Red, or mixtures thereof, for example:

(1) Tris-Azo Direct Blue Dyes of the Formula

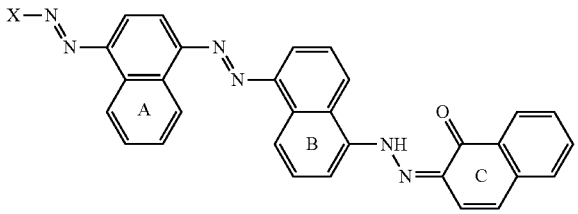

where at least two of the A, B and C napthyl rings are substituted by a sulfonate group, the C ring may be substituted at the 5 position by an $NH_2$ or NHPh group, X is a benzyl or naphthyl ring substituted with up to 2 sulfonate groups and may be substituted at the 2 position with an OH group and may also be substituted with an $NH_2$ or NHPh group.

(2) Bis-Azo Direct Violet Dyes of the Formula:

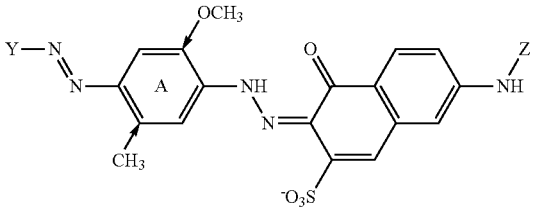

where Z is H or phenyl, the A ring is preferably substituted by a methyl and methoxy group at the positions indicated by arrows, the A ring may also be a naphthyl ring, the Y group is a benzyl or naphthyl ring, which is substituted by sulfate group and may be mono or disubstituted by methyl groups.

(3) Blue or Red Acid Dyes of the Formula

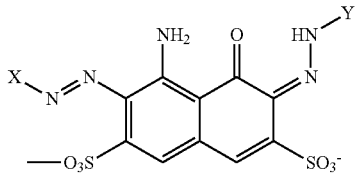

where at least one of X and Y must be an aromatic group. In one aspect, both the aromatic groups may be a substituted benzyl or naphthyl group, which may be substituted with non water-solubilising groups such as alkyl or alkyloxy or aryloxy groups, X and Y may not be substituted with water solubilising groups such as sulfonates or carboxylates. In another aspect, X is a nitro substituted benzyl group and Y is a benzyl group (4) Red Acid Dyes of the Structure

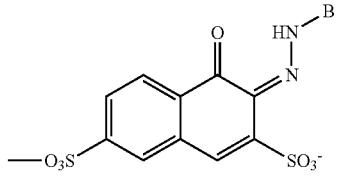

or

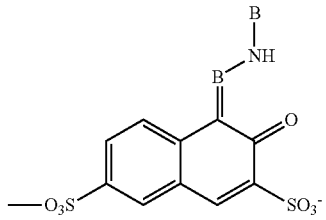

where B is a naphthyl or benzyl group that may be substituted with non water solubilising groups such as alkyl or alkyloxy or aryloxy groups, B may not be substituted with water solubilising groups such as sulfonates or carboxylates.

(5) Dis-Azo Dyes of the Structure

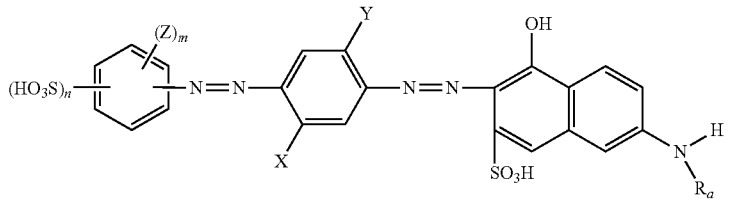

or

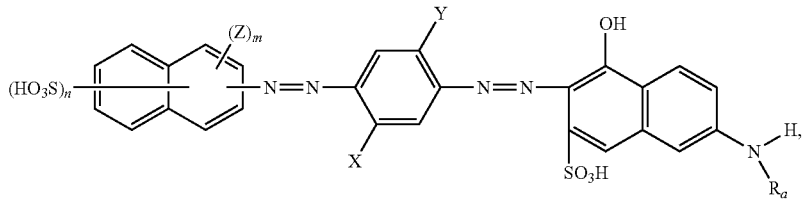

wherein X and Y, independently of one another, are each hydrogen, $C_1$-$C_4$ alkyl or $C_1$-$C_4$-alkoxy, Rα is hydrogen or aryl, Z is $C_1$-$C_4$ alkyl; $C_1$-$C_4$-alkoxy; halogen; hydroxyl or carboxyl, n is 1 or 2 and m is 0, 1 or 2, as well as corresponding salts thereof and mixtures thereof
(6) Triphenylmethane Dyes of the Following Structures
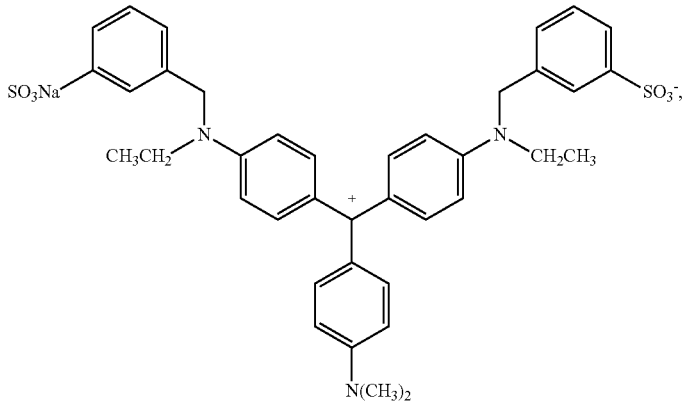
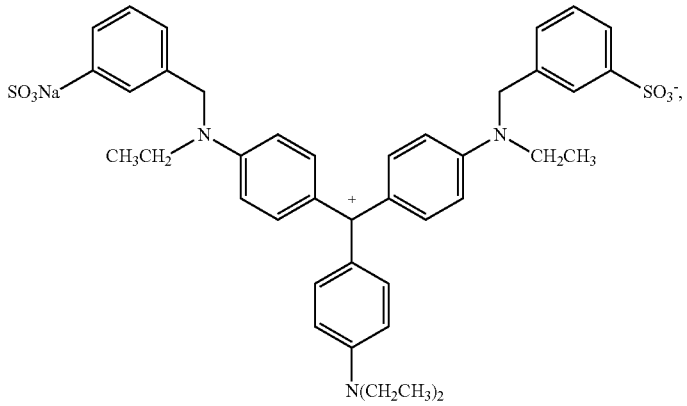
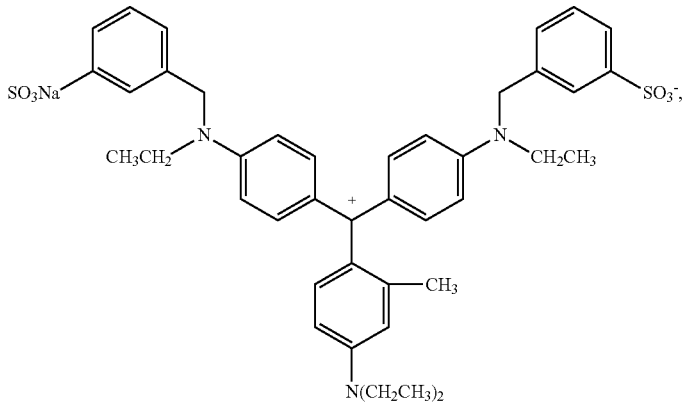

-continued

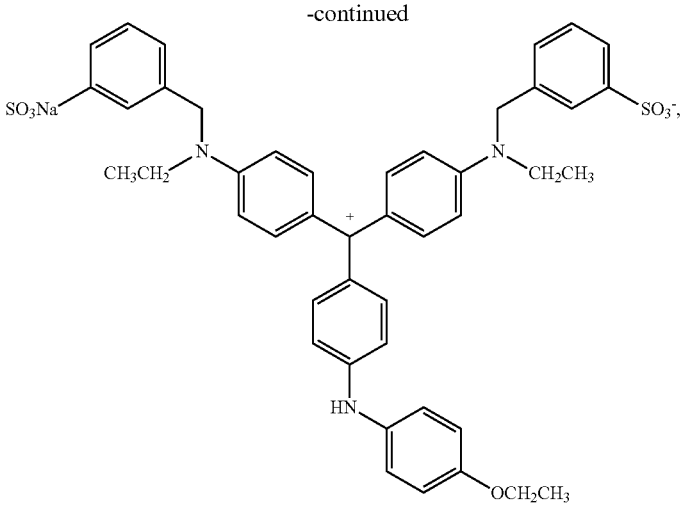

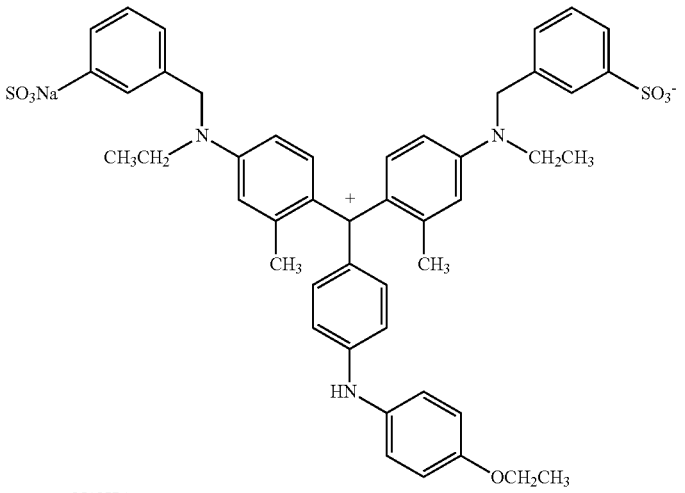

and/or

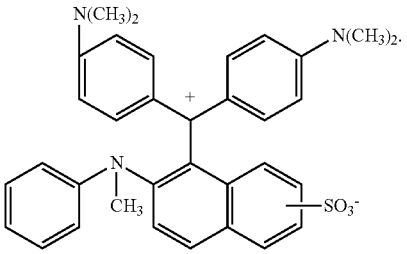

and mixtures thereof. In another aspect, suitable small molecule dyes include small molecule dyes selected from the group consisting of Colour Index (Society of Dyers and Colourists, Bradford, UK) numbers Direct Violet 9, Direct Violet 35, Direct Violet 48, Direct Violet 51, Direct Violet 66, Direct Blue 1, Direct Blue 71, Direct Blue 80, Direct Blue 279, Acid Red 17, Acid Red 73, Acid Red 88, Acid Red 150, Acid Violet 15, Acid Violet 17, Acid Violet 24, Acid Violet 43, Acid Red 52, Acid Violet 49, Acid Blue 15, Acid Blue 17, Acid Blue 25, Acid Blue 29, Acid Blue 40, Acid Blue 45, Acid Blue 75, Acid Blue 80, Acid Blue 83, Acid Blue 90 and Acid Blue 113, Acid Black 1, Basic Violet 1, Basic Violet 3, Basic Violet 4, Basic Violet 10, Basic Violet 35, Basic Blue 3, Basic Blue 16, Basic Blue 22, Basic Blue 47, Basic Blue 66, Basic Blue 75, Basic Blue 159 and mixtures thereof. In another aspect, suitable small molecule dyes include small molecule dyes selected from the group consisting of Colour Index (Society of Dyers and Colourists, Bradford, UK) numbers Acid Violet 17, Acid Violet 43, Acid Red 52, Acid Red 73, Acid Red 88, Acid Red 150, Acid Blue 25, Acid Blue 29, Acid Blue 45, Acid Blue 113, Acid Black 1, Direct Blue 1, Direct Blue 71, Direct Violet 51 and mixtures thereof. In another aspect, suitable small molecule dyes include small molecule dyes selected from the group consisting of Colour Index (Society of Dyers and Colourists, Bradford, UK) numbers Acid Violet 17, Direct Blue 71, Direct Violet 51, Direct Blue 1, Acid Red 88, Acid Red 150, Acid Blue 29, Acid Blue 113 or mixtures thereof.

Suitable polymeric dyes include polymeric dyes selected from the group consisting of polymers containing conjugated chromogens (dye-polymer conjugates) and polymers with chromogens co-polymerized into the backbone of the polymer and mixtures thereof.

In another aspect, suitable polymeric dyes include polymeric dyes selected from the group consisting of fabric-substantive colorants sold under the name of Liquitint® (Milliken, Spartanburg, S.C., USA), dye-polymer conjugates formed from at least one reactive dye and a polymer selected from the group consisting of polymers comprising a moiety selected from the group consisting of a hydroxyl moiety, a primary amine moiety, a secondary amine moiety, a thiol moiety and mixtures thereof. In still another aspect, suitable polymeric dyes include polymeric dyes selected from the group consisting of Liquitint® (Milliken, Spartanburg, S.C., USA) Violet CT, carboxymethyl cellulose (CMC) conjugated with a reactive blue, reactive violet or reactive red dye such as CMC conjugated with C.I. Reactive Blue 19, sold by Megazyme, Wicklow, Ireland under the product name AZO-CM-CELLULOSE, product code S-ACMC, alkoxylated triphenyl-methane polymeric colourants, alkoxylated thiophene polymeric colourants, and mixtures thereof.

Suitable dye clay conjugates include dye clay conjugates selected from the group comprising at least one cationic/basic dye and a smectite clay, and mixtures thereof. In another aspect, suitable dye clay conjugates include dye clay conjugates selected from the group consisting of one cationic/basic dye selected from the group consisting of C.I. Basic Yellow 1 through 108, C.I. Basic Orange 1 through 69, C.I. Basic Red 1 through 118, C.I. Basic Violet 1 through 51, C.I. Basic Blue 1 through 164, C.I. Basic Green 1 through 14, C.I. Basic Brown 1 through 23, CI Basic Black 1 through 11, and a clay selected from the group consisting of Montmorillonite clay, Hectorite clay, Saponite clay and mixtures thereof. In still another aspect, suitable dye clay conjugates include dye clay conjugates selected from the group consisting of: Montmorillonite Basic Blue B7 C.I. 42595 conjugate, Montmorillonite Basic Blue B9 C.I. 52015 conjugate, Montmorillonite Basic Violet V3 C.I. 42555 conjugate, Montmorillonite Basic Green G1 C.I. 42040 conjugate, Montmorillonite Basic Red R1 C.I. 45160 conjugate, Montmorillonite C.I. Basic Black 2 conjugate, Hectorite Basic Blue B7 C.I. 42595 conjugate, Hectorite Basic Blue B9 C.I. 52015 conjugate, Hectorite Basic Violet V3 C.I. 42555 conjugate, Hectorite Basic Green G1 C.I. 42040 conjugate, Hectorite Basic Red R1 C.I. 45160 conjugate, Hectorite C.I. Basic Black 2 conjugate, Saponite Basic Blue B7 C.I. 42595 conjugate, Saponite Basic Blue B9 C.I. 52015 conjugate, Saponite Basic Violet V3 C.I. 42555 conjugate, Saponite Basic Green G1 C.I. 42040 conjugate, Saponite Basic Red R1 C.I. 45160 conjugate, Saponite C.I. Basic Black 2 conjugate and mixtures thereof.

Suitable pigments include pigments selected from the group consisting of flavanthrone, indanthrone, chlorinated indanthrone containing from 1 to 4 chlorine atoms, pyranthrone, dichloropyranthrone, monobromodichloropyranthrone, dibromodichloropyranthrone, tetrabromopyranthrone, perylene-3,4,9,10-tetracarboxylic acid diimide, wherein the imide groups may be unsubstituted or substituted by C1-C3-alkyl or a phenyl or heterocyclic radical, and wherein the phenyl and heterocyclic radicals may additionally carry substituents which do not confer solubility in water, anthrapyrimidinecarboxylic acid amides, violanthrone, isoviolanthrone, dioxazine pigments, copper phthalocyanine which may contain up to 2 chlorine atoms per molecule, polychloro-copper phthalocyanine or polybromochloro-copper phthalocyanine containing up to 14 bromine atoms per molecule and mixtures thereof. In another aspect, suitable pigments include pigments selected from the group consisting of Ultramarine Blue (C.I. Pigment Blue 29), Ultramarine Violet (C.I. Pigment Violet 15) and mixtures thereof.

The aforementioned fabric hueing agents can be used in combination (any mixture of fabric hueing agents can be used). Suitable fabric hueing agents can be purchased from Aldrich, Milwaukee, Wis., USA; Ciba Specialty Chemicals, Basel, Switzerland; BASF, Ludwigshafen, Germany; Dayglo Color Corporation, Mumbai, India; Organic Dyestuffs Corp., East Providence, R.I., USA; Dystar, Frankfurt, Germany; Lanxess, Leverkusen, Germany; Megazyme, Wicklow, Ireland; Clariant, Muttenz, Switzerland; Avecia, Manchester, UK and/or made in accordance with the examples contained herein.

Suitable hueing agents are described in more detail in U.S. Pat. No. 7,208,459 B2.

TEST METHOD 1

A protocol to define whether a dye or pigment material is a fabric hueing agent for the purpose of the invention is given here:

1.) Fill two tergotometer pots with 800 ml of Newcastle upon Tyne, UK, City Water (~12 grains per US gallon total hardness, supplied by Northumbrian Water, Pity Me., Durham, Co. Durham, UK).
2) Insert pots into tergotometer, with water temperature controlled at 30° C. and agitation set at 40 rpm for the duration of the experiment.
3) Add 4.8 g of IEC-B detergent (IEC 60456 Washing Machine Reference Base Detergent Type B), supplied by wfk, Brüggen-Bracht, Germany, to each pot.
4) After two minutes, add 2.0 mg active colorant to the first pot.
5) After one minute, add 50 g of flat cotton vest (supplied by Warwick Equest, Consett, County Durham, UK), cut into 5 cm×5 cm swatches, to each pot.
6) After 10 minutes, drain the pots and re-fill with cold Water (16° C.) having a water hardness of 14.4 English Clark Degrees Hardness with a 3:1 Calcium to Magnesium molar ratio.
7) After 2 minutes rinsing, remove fabrics.
8) Repeat steps 3-7 for a further three cycles using the same treatments.
9) Collect and line dry the fabrics indoors for 12 hours.
10) Analyse the swatches using a Hunter Miniscan spectrometer fitted with D65 illuminant and UVA cutting filter, to obtain Hunter a (red-green axis) and Hunter b (yellow-blue axis) values.
11) Average the Hunter a and Hunter b values for each set of fabrics. If the fabrics treated with colorant under assessment show an average difference in hue of greater than 0.2 units on either the a axis or b axis, it is deemed to be a fabric hueing agent for the purpose of the invention.

Enzyme

Extremely highly preferably, the laundry detergent composition comprises enzyme. Suitable enzymes include:

1. Enzymes from E.C. 1.1.3.x (oxidoreductases acting on CH—OH as donor and with oxygen as acceptor). Examples of suitable oxidoreductases categorized as E.C. 1.1.3.x are glucose oxidase, aryl-alcohol oxidase and galactose oxidase. A suitable hexose oxidase is OxyGo® 1500 (Danisco).
2. Enzymes from E.C. 1.11.x.x (oxidoreductases acting on peroxide as acceptor). An example of a suitable oxidoreductase acting on peroxide as acceptor is Guardzyme® (Novozymes).
3. Enzymes from E.C. 2.3.x.x (acyltransferases).
4. Enzymes from E.C. 2.4.x.x (glycosyl transferases).
5. Enzymes from E.C. 3.1.1.1 (carboxylesterase).
6. Enzymes from E.C. 3.1.1.3 (triacylglycerol lipase). Lipases have E.C. classification 3.1.1.3, as defined by EC classification, IUPAC-IUBMB. Suitable lipases include both wild-types and genetically modified variants thereof possessing at least about 90%, at least about 95%, at least about 98%, or at least about 99%, or 100% identity with said lipase. In one aspect, the lipase is a variant of the wild-type lipase from *Thermomyces lanuginosus* comprising the T231R and N233R mutations. The wild-type sequence is the 269 amino acids (amino acids 23-291) of the Swissprot accession number Swiss-Prot 059952 (derived from *Thermomyces lanuginosus* (*Humicola lanuginosa*). Suitable commercially available lipases include Lipolase®, Lipolase Ultra®, Lipex® and Lipolex®, all available from Novozymes A/S.

7. Enzymes from E.C. 3.1.1.20 (tannase). Suitable tannases are disclosed in WO 06/002955A2.
8. Enzymes from E.C. 3.1.1.42 (chlorogenate hydrolase).
9. Enzymes from E.C. 3.1.1.73 (feruloyl esterase). Suitable ferulic acid etserases are derived from Aspergillus awamori, Aspergillus tubingensis, Aspergillus niger, Talaromyces stipatus, Piromyces equi cellvibrio japonicus, Talaromyces stipatus and *Clostridium Japonicus*. Further suitable ferulic acid esterases are disclosed in Acta Biochimica et Biophysica Sinica, 2007, 39(11):811-828, which is incorporated herein by reference.
10. Enzymes from E.C. 3.1.1.74 (cutinase). In one aspect, the enzyme may comprise a cutinase as defined by E.C. Class 3.1.1.73. The enzyme may have at least about 90% or about 95%, or about 98% identity with a wild-type from one of *Fusarium solani, Pseudomonas Mendocina* or *Humicola Insolens*.
11. Enzymes from E.C. 3.2.1.1 (α-amylase). Alpha amylases belong to E.C. Class 3.2.1.1. Suitable alpha-amylases include those of bacterial or fungal origin. Chemically or genetically modified mutants (variants) are included. A preferred alkaline alpha-amylase is derived from a strain of *Bacillus*, such as *Bacillus licheniformis, Bacillus amyloliquefaciens, Bacillus stearothermophilus, Bacillus subtilis*, or other *Bacillus* sp., such as *Bacillus* sp. NCIB 12289, NCIB 12512, NCIB 12513, DSM 9375 (USP 7,153,818) DSM 12368, DSMZ no. 12649, KSM AP1378 (WO 97/00324), KSM K36 or KSM K38 (EP 1,022,334). Preferred amylases include:
    (a) the variants described in WO 94/02597, WO 94/18314, WO96/23874 and WO 97/43424, especially the variants with substitutions in one or more of the following positions versus the enzyme listed as SEQ ID No. 2 in WO 96/23874: 15, 23, 105, 106, 124, 128, 133, 154, 156, 181, 188, 190, 197, 202, 208, 209, 243, 264, 304, 305, 391, 408, and 444;
    (b) the variants described in U.S. Pat. No. 5,856,164 and WO99/23211, WO 96/23873, WO00/60060 and WO 06/002643, especially the variants with one or more substitutions in the following positions versus the AA560 enzyme listed as SEQ ID No. 12 in WO 06/002643: 26, 30, 33, 82, 37, 106, 118, 128, 133, 149, 150, 160, 178, 182, 186, 193, 203, 214, 231, 256, 257, 258, 269, 270, 272, 283, 295, 296, 298, 299, 303, 304, 305, 311, 314, 315, 318, 319, 339, 345, 361, 378, 383, 419, 421, 437, 441, 444, 445, 446, 447, 450, 461, 471, 482, 484, preferably that also contain the deletions of D183* and G184*; and
    (c) variants exhibiting at least 90% identity with SEQ ID No. 4 in W006/002643, the wild-type enzyme from Bacillus SP722, especially variants with deletions in the 183 and 184 positions and variants described in WO 00/60060, which is incorporated herein by reference. Suitable commercially available alpha-amylases are DURAMYL®, LIQUEZYME® TERMAMYL®, TERMAMYL ULTRA®, NATALASE®, SUPRAMYL®, STAINZYME®, STAINZYME PLUS®, FUNGAMYL® and BAN® (Novozymes A/S), BIOAMYLASE—D(G), BIOAMYLASE® L (Biocon India Ltd.), KEMZYM® AT 9000 (Biozym Ges. m.b.H, Austria), RAPIDASE®, PURASTAR®, OPTISIZE HT PLUS® and PURASTAR OXAM® (Genencor International Inc.) and KAM® (KAO, Japan). In one aspect, preferred amylases are NATALASE®, STAINZYME® and STAINZYME PLUS®.
12. Enzymes from E.C. 3.2.1.2 (β-amylase).
13. Enzymes from E.C. 3.2.1.4 (cellulase), E.C. 3.2.1.21 (β-glucosidase) and E.C. 3.2.1.91 (cellulose 1,4-β-cellobiosidase). Suitable cellulases include cellulases from the genera *Bacillus, Pseudomonas, Humicola, Fusarium, Thielavia, Acremonium*, e.g. the fungal cellulases produced from *Humicola insolens, Myceliophthora thermophila, Fusarium oxysporum* disclosed in U.S. Pat. No. 4,435,3077, U.S. Pat. No. 5,648,263, U.S. Pat. No. 5,691,178, U.S. Pat. No. 5,776,757 and WO 89/09259. Other suitable cellulases are the alkaline or neutral cellulases having colour care benefits. Examples of such cellulases are cellulases described in EP 0 495 257, EP 0 531 372, WO 96/1 1262, WO 96/29397, WO 98/08940. Other examples are cellulase variants such as those described in WO 94/07998, EP 0 531 315, U.S. Pat. No. 5,457,046, U.S. Pat. No. 5,686,593, U.S. Pat. No. 5,763,254, WO 95/24471, WO 98/12307 and WO 99/01544, and WO 01/062903. Commercially available cellulases include Celluclean®, Celluzyme®, Renozyme® and Carezyme®; (Novozymes A/S), Clazinase®; and Puradax HA®; (Genencor International Inc.), and KAC® 500; (Kao Corporation) and those sold under the Biotouch® and Ecostone® brand names (AB Enzymes).

Particularly suitable cellulases are variants of the Family 44 cellulase showing xyloglucanase activity disclosed in WO 2001/062903 (Novozymes).

14. Enzymes from E.C. 3.2.1.20 (α-glucosidase).
15. Enzymes from E.C. 3.2.1.25 (β-mannosidase) and E.C. 3.2.1.78 (mannan endo-1,4-β-mannosidase). Suitable mannan endo-1,4-β-mannosidases are described in WO 99/09126, WO99/64573 and WO99/09128. Preferred mannanases are sol under the tradenames Mannaway® (Novozymes A/S) and Purabrite® (Genencor International).
16. Enzymes from E.C. 3.2.1.151 (xyloglucan-specific endo-β-1,4-glucanase).
17. Enzymes from E.C. 3.2.1.155 (xyloglucan-specific exo-β-1,4-glucanase).
18. Enzymes from E.C. 3.4.x.x (peptidases). Suitable proteases include those of animal, vegetable or microbial origin. Microbial origin is preferred. Chemically or genetically modified mutants are included. The protease may be a serine protease, preferably an alkaline microbial protease or a trypsin-like protease. Examples of neutral or alkaline proteases include:
    (a) subtilisins (EC 3.4.21.62), especially those derived from *Bacillus*, such as *Bacillus lentus, B. alkalophilus, B. subtilis, B. amyloliquefaciens, Bacillus pumilus* and *Bacillus gibsonii*, and *Cellumonas* described in U.S. Pat. No. 6,312,936 B1, U.S. Pat. No. 5,679,630, U.S. Pat. No. 4,760,025, U.S. Pat. No. 5,030,378, WO 05/052146, DEA6022216A1 and DEA 6022224A1;
    (b) trypsin-like proteases are trypsin (e.g., of porcine or bovine origin) and the Fusarium protease described in WO 89/06270; and (c) metalloproteases, especially those derived from *Bacillus amyloliquefaciens* described in WO 07/044993A2. Preferred proteases are those derived from the BPN' and Carlsberg families, especially the subtilisin BPN' protease derived from *Bacillus amyloliquefaciens*. In one aspect, the protease is a variant of the subtilisin BPN' wild-type enzyme derived from *Bacillus amyloliquefaciens* that contains the Y217L mutation. The subtilisin BPN' wild-type enzyme sequence is the 275 amino acids (amino acids 108-382) of the Swissprot accession no. P00782 (derived from *Bacillus amyloliquefaciens*). Preferred commercially available protease enzymes include those sold under the trade names Alcalase®, Savinase®, Primase®, Durazym®, Polarzyme®, Kannase®, Liquanase®, Ovozyme®, Neutrase®, Everlase® and Esperase® by Novozymes A/S (Denmark), those sold under the tradename Maxatase®, Maxacal®, Maxapem®, Properase®, Purafect®, Purafect Prime®, Purafect Ox®, FN3®, FN4®, Excellase® and Purafect OXP® by Genencor International, and those sold under the tradename Opticlean® and Optimase® by Solvay Enzymes. In one aspect, the preferred protease is that sold under the tradename Purafect Prime®, supplied by Genencor International.

19. Enzymes from E.C. 4.2.2.2 (pectate lyase). In one aspect the enzyme may comprise a pectate lyase. Suitable pectate lyases are described in WO 00/42151 and WO 00/42147. Preferred pectate lyases are sold under the tradenames Pectawash® and Pectaway® by Novozymes A/S.

20. Enzymes from E.C. 4.2.2.10 (pectin lyase).

Detersive Surfactant

The composition comprises greater than 1 wt % detersive surfactant, preferably from 10 wt % to 40 wt %, preferably from 12 wt %, or from 15 wt %, or even from 18 wt % detersive surfactant. Preferably, the surfactant comprises alkyl benzene sulphonate and one or more detersive co-surfactants. The surfactant preferably comprises $C_{10}$-$C_{13}$ alkyl benzene sulphonate and one or more co-surfactants. The co-surfactants preferably are selected from the group consisting of $C_{12}$-$C_{18}$ alkyl ethoxylated alcohols, preferably having an average degree of ethoxylation of from 1 to 7; $C_{12}$-$C_{18}$ alkyl ethoxylated sulphates, preferably having an average degree of ethoxylation of from 1 to 5; and mixtures thereof. However, other surfactant systems may be suitable for use in the present invention.

Suitable detersive surfactants include anionic detersive surfactants, nonionic detersive surfactants, cationic detersive surfactants, zwitterionic detersive surfactants, amphoteric detersive surfactants and mixtures thereof.

Suitable anionic detersive surfactants include: alkyl sulphates; alkyl sulphonates; alkyl phosphates; alkyl phosphonates; alkyl carboxylates; and mixtures thereof. The anionic surfactant can be selected from the group consisting of: $C_{10}$-$C_{18}$ alkyl benzene sulphonates (LAS) preferably $C_{10}$-$C_{13}$ alkyl benzene sulphonates; $C_{10}$-$C_{20}$ primary, branched chain, linear-chain and random-chain alkyl sulphates (AS), typically having the following formula:

$$CH_3(CH_2)xCH_2—OSO_3^-M^+$$

wherein, M is hydrogen or a cation which provides charge neutrality, preferred cations are sodium and ammonium cations, wherein x is an integer of at least 7, preferably at least 9; $C_{10}$-$C_{18}$ secondary (2,3) alkyl sulphates, typically having the following formulae:

$$CH_3(CH_2)_x(\overset{OSO_3^-M^+}{\overset{|}{C}}H)CH_3 \quad \text{or} \quad CH_3(CH_2)_y(\overset{OSO_3^-M^+}{\overset{|}{C}}H)CH_2CH_3$$

wherein, M is hydrogen or a cation which provides charge neutrality, preferred cations include sodium and ammonium cations, wherein x is an integer of at least 7, preferably at least 9, y is an integer of at least 8, preferably at least 9; $C_{10}$-$C_{18}$ alkyl alkoxy carboxylates; mid-chain branched alkyl sulphates as described in more detail in U.S. Pat. No. 6,020,303 and U.S. Pat. No. 6,060,443; modified alkylbenzene sulphonate (MLAS) as described in more detail in WO 99/05243, WO 99/05242, WO 99/05244, WO 99/05082, WO 99/05084, WO 99/05241, WO 99/07656, WO 00/23549, and WO 00/23548; methyl ester sulphonate (MES); alpha-olefin sulphonate (AOS) and mixtures thereof.

Preferred anionic detersive surfactants include: linear or branched, substituted or unsubstituted alkyl benzene sulphonate detersive surfactants, preferably linear $C_8$-$C_{18}$ alkyl benzene sulphonate detersive surfactants; linear or branched, substituted or unsubstituted alkyl benzene sulphate detersive surfactants; linear or branched, substituted or unsubstituted alkyl sulphate detersive surfactants, including linear $C_8$-$C_{18}$ alkyl sulphate detersive surfactants, $C_1$-$C_3$ alkyl branched $C_8$-$C_{18}$ alkyl sulphate detersive surfactants, linear or branched alkoxylated $C_8$-$C_{18}$ alkyl sulphate detersive surfactants and mixtures thereof; linear or branched, substituted or unsubstituted alkyl sulphonate detersive surfactants; and mixtures thereof.

Preferred alkoxylated alkyl sulphate detersive surfactants are linear or branched, substituted or unsubstituted $C_{8-18}$ alkyl alkoxylated sulphate detersive surfactants having an average degree of alkoxylation of from 1 to 30, preferably from 1 to 10. Preferably, the alkoxylated alkyl sulphate detersive surfactant is a linear or branched, substituted or unsubstituted $C_{8-18}$ alkyl ethoxylated sulphate having an average degree of ethoxylation of from 1 to 10. Most preferably, the alkoxylated alkyl sulphate detersive surfactant is a linear unsubstituted $C_{8-18}$ alkyl ethoxylated sulphate having an average degree of ethoxylation of from 3 to 7. Preferably, the laundry detergent composition comprises an alkyl ethoxylated sulphate having an average degree of ethoxylation of from 0.5 to 3.5, preferably from 1.0 to 3.0, and preferably 1.0 or 3.0.

Preferred anionic detersive surfactants are selected from the group consisting of: linear or branched, substituted or unsubstituted, $C_{12-18}$ alkyl sulphates; linear or branched, substituted or unsubstituted, $C_{10-13}$ alkylbenzene sulphonates, preferably linear $C_{10-13}$ alkylbenzene sulphonates; and mixtures thereof. Highly preferred are linear $C_{10-13}$ alkylbenzene sulphonates. Highly preferred are linear $C_{10-13}$ alkylbenzene sulphonates that are obtainable, preferably obtained, by sulphonating commercially available linear alkyl benzenes (LAB); suitable LAB include low 2-phenyl LAB, such as those supplied by Sasol under the tradename Isochem® or those supplied by Petresa under the tradename Petrelab®, other suitable LAB include high 2-phenyl LAB, such as those supplied by Sasol under the tradename Hyblene®. A suitable anionic detersive surfactant is alkyl benzene sulphonate that is obtained by DETAL catalyzed process, although other synthesis routes, such as HF, may also be suitable. Preferably, the laundry detergent composition comprises a predominantly $C_{12}$ alkyl sulphate.

Suitable cationic detersive surfactants include: alkyl pyridinium compounds; alkyl quaternary ammonium compounds; alkyl quaternary phosphonium compounds; alkyl ternary sulphonium compounds; and mixtures thereof. The cationic detersive surfactant can be selected from the group consisting of: alkoxylate quaternary ammonium (AQA) surfactants as described in more detail in U.S. Pat. No. 6,136,769; dimethyl hydroxyethyl quaternary ammonium as described in more detail in U.S. Pat. No. 6,004,922; polyamine cationic surfactants as described in more detail in WO 98/35002, WO 98/35003, WO 98/35004, WO 98/35005, and WO 98/35006; cationic ester surfactants as described in more detail in U.S. Pat. No. 4,228,042, U.S. Pat. No. 4,239,660, U.S. Pat. No. 4,260,529 and U.S. Pat. No. 6,022,844; amino surfactants as described in more detail in U.S. Pat. No. 6,221,825 and WO 00/47708, specifically amido propyldimethyl amine; and mixtures thereof. Preferred cationic detersive surfactants are quaternary ammonium compounds having the general formula:

$$(R)(R_1)(R_2)(R_3)N^+X^-$$

wherein, R is a linear or branched, substituted or unsubstituted $C_{6-18}$ alkyl or alkenyl moiety, $R_1$ and $R_2$ are independently selected from methyl or ethyl moieties, $R_3$ is a hydroxyl, hydroxymethyl or a hydroxyethyl moiety, X is an anion which provides charge neutrality, preferred anions include halides (such as chloride), sulphate and sulphonate. Preferred cationic detersive surfactants are mono-$C_{6-18}$ alkyl mono-hydroxyethyl di-methyl quaternary ammonium chlorides. Highly preferred cationic detersive surfactants are mono-$C_{8-10}$ alkyl mono-hydroxyethyl di-methyl quaternary ammonium chloride, mono-$C_{10-12}$ alkyl mono-hydroxyethyl di-methyl quaternary ammonium chloride and mono-$C_{10}$ alkyl mono-hydroxyethyl di-methyl quaternary ammonium chloride.

Suitable non-ionic detersive surfactant can be selected from the group consisting of: $C_8$-$C_{18}$ alkyl ethoxylates, such as, NEODOL® non-ionic surfactants from Shell; $C_6$-$C_{12}$ alkyl phenol alkoxylates wherein the alkoxylate units are ethyleneoxy units, propyleneoxy units or a mixture thereof; $C_{12}$-$C_{18}$ alcohol and $C_6$-$C_{12}$ alkyl phenol condensates with ethylene oxide/propylene oxide block polymers such as Pluronic® from BASF; $C_{14}$-$C_{22}$ mid-chain branched alcohols, BA, as described in more detail in U.S. Pat. No. 6,150,322; $C_{14}$-$C_{22}$ mid-chain branched alkyl alkoxylates, BAEx, wherein x=from 1 to 30, as described in more detail in U.S. Pat. No. 6,153,577, U.S. Pat. No. 6,020,303 and U.S. Pat. No. 6,093,856; alkylpolysaccharides as described in more detail in U.S. Pat. No. 4,565,647, specifically alkylpolyglycosides as described in more detail in U.S. Pat. No. 4,483,780 and U.S. Pat. No. 4,483,779; polyhydroxy fatty acid amides as described in more detail in U.S. Pat. No. 5,332,528, WO 92/06162, WO 93/19146, WO 93/19038, and WO 94/09099; ether capped poly(oxyalkylated) alcohol surfactants as described in more detail in U.S. Pat. No. 6,482,994 and WO 01/42408; and mixtures thereof.

The non-ionic detersive surfactant could be an alkyl polyglucoside and/or an alkyl alkoxylated alcohol. Preferably the non-ionic detersive surfactant is a linear or branched, substituted or unsubstituted $C_{8-18}$ alkyl ethoxylated alcohol having an average degree of ethoxylation of from 1 to 10, more preferably from 3 to 7.

Amphilic Graft Co-Polymer

The laundry detergent composition preferably comprises an amphilic graft co-polymer, preferably the amphilic graft co-polymer comprises (i) polyethyelene glycol backbone; and (ii) and at least one pendant moiety selected from polyvinyl acetate, polyvinyl alcohol and mixtures thereof. A preferred amphilic graft co-polymer is Sokalan HP22, supplied from BASF.

Cellulosic Based Polymer

Preferably, the laundry detergent composition comprises cellulosic based polymer. The cellulosic based polymer can be any polymer that is or derived from cellulose. Suitable cellulosic based polymers include anionically modified celluloses, non-ionically modified celluloses, cationically modified celluloses, zwitterionically modified celluloses, and any mixture thereof. Suitable cellulosic based polymers can be both non-ionically modified and anionically modified, such as a cellulose that is modified by the incorporation of both an alkyl and a carboxymethyl substituent moiety.

The cellulosic based polymer is typically a cellulose or a modified cellulose. Suitable cellulosic based polymers include cellulose, cellulose ethers, cellulose esters, cellulose amides and mixtures thereof. Suitable cellulosic based polymers include anionically modified cellulose, nonionically modified cellulose, cationically modified cellulose, zwitterionically modified cellulose, and mixtures thereof. Suitable cellulosic based polymers include methyl cellulose, carboxy methyl cellulose, ethyl cellulose, hydroxyl ethyl cellulose, hydroxyl propyl methyl cellulose, ester carboxy methyl cellulose, and mixtures thereof.

Other suitable cellulosic based polymers include cationic cellulose and derivatives thereof. Suitable cationic cellulose is available from Amerchol Corp. (Edison, N.J., USA) in their Polymer JR™ and LR™ series of polymers. Other suitable cationic cellulose is the form of a salt of hydroxyethyl cellulose that is reacted with trimethyl ammonium substituted epoxide, such as that supplied by Amerchol Corp. under the tradename Polyquaternium 10™. Another suitable type of cationic cellulose includes the polymeric quaternary ammonium salts of hydroxyethyl cellulose reacted with lauryl dimethyl ammonium-substituted epoxide, such as that supplied by Amerchol Corp. under the tradename Polyquaternium 24™. Suitable cellulosic polymers are supplied by Amerchol Corp. under the tradename Polymer LM-200™. Other suitable cellulosic based polymers include methylhydroxyethyl cellulose TYLOSE MH50™, hydroxypropylmethyl cellulose METHOCEL F4M™. Other suitable cellulosic based polymers include: quaternary nitrogen-containing cellulose ethers, such as those described in more detail in U.S. Pat. No. 3,962,418; and copolymers of etherified cellulose and starch, such as those described in more detail in U.S. Pat. No. 3,958,581.

Most preferably, the cellulosic based polymer is carboxy methyl cellulose, typically having the following general formula:

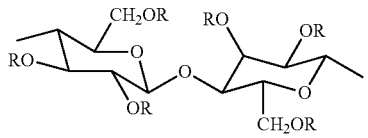

R = H or $CH_2COO^-$ and wherein at least one R moiety is $CH_2COO^-$.

Preferred cellulosic based polymers are selected from the group consisting of: cellulose; carboxymethyl cellulose; methyl cellulose; ethyl cellulose; hydroxyethyl cellulose; alkyl cellulose; mixture of alkyl and carboxymethyl cellulose; and mixtures thereof. Highly preferred are carboxymethyl cellulose and/or methyl cellulose. Most preferred cellulosic based polymers are carboxymethyl cellulose.

Polymeric Carboxylate

The composition preferably comprises polymeric carboxylate. It may be preferred for the composition to comprise at least 5 wt % or at least 6 wt %, or at least 7 wt %, or at least 8 wt %, or even at least 9 wt %, by weight of the composition, of polymeric carboxylate. The polymeric carboxylate can sequester free calcium ions in the wash liquor. The carboxylate polymers can also act as soil dispersants and can provide an improved particulate stain removal cleaning benefit. Preferred polymeric carboxylates include: polyacrylates, preferably having a weight average molecular weight of from 1,000 Da to 20,000 Da; co-polymers of maleic acid and acrylic acid, preferably having a molar ratio of maleic acid monomers to acrylic acid monomers of from 1:1 to 1:10 and a weight average molecular weight of from 10,000 Da to 200,000 Da, or preferably having a molar ratio of maleic acid monomers to acrylic acid monomers of from 0.3:1 to 3:1 and a weight average molecular weight of from 1,000 Da to 50,000 Da.

Zeolite Builder

Preferably, the composition comprise from 0 wt % to 10 wt % zeolite builder, preferably to 8 wt %, or to 6 wt %, or to 4 wt %, or even to 2 wt % zeolite builder. The composition may even be substantially free of zeolite builder, substantially free means "no deliberately added". Typical zeolite builders are zeolite A, zeolite P and zeolite MAP.

Phosphate Builder

Preferably, the composition comprise from 0 wt % to 10 wt % phosphate builder, preferably to 8 wt %, or to 6 wt %, or to 4 wt %, or even to 2 wt % phosphate builder. The composition may even be substantially free of phosphate builder, substantially free means "no deliberately added". A typical phosphate builder is sodium tri-polyphosphate.

Source of Carbonate

The composition may comprise a source of carbonate. Preferred sources of carbonate include sodium carbonate and/or sodium bicarbonate. A highly preferred source of carbonate is sodium carbonate. Sodium percarbonate may also be used as the source of carbonate. Preferably, the composition comprises from 0 wt % to 10 wt % sodium carbonate.

Other Detergent Ingredients

The composition typically comprises other detergent ingredients. Suitable detergent ingredients include: transition metal catalysts; enzymes such as amylases, carbohydrases, cellulases, laccases, lipases, bleaching enzymes such as oxidases and peroxidases, proteases, pectate lyases and mannanases; suds suppressing systems such as silicone based suds suppressors; brighteners; hueing agents; photobleach; fabric-softening agents such as clay, silicone and/or quaternary ammonium compounds; flocculants such as polyethylene oxide; dye transfer inhibitors such as polyvinylpyrrolidone, poly 4-vinylpyridine N-oxide and/or co-polymer of vinylpyrrolidone and vinylimidazole; fabric integrity components such as oligomers produced by the condensation of imidazole and epichlorhydrin; soil dispersants and soil anti-redeposition aids such as alkoxylated polyamines and ethoxylated ethyleneimine polymers; anti-redeposition components such as polyesters; perfumes such as perfume microcapsules; soap rings; aesthetic particles; dyes; fillers such as sodium sulphate, although it is preferred for the composition to be substantially free of fillers; silicate salt such as sodium silicate, including 1.6R and 2.0R sodium silicate, or sodium metasilicate; co-polyesters of di-carboxylic acids and diols; cellulosic polymers such as methyl cellulose, carboxymethyl cellulose, hydroxyethoxycellulose, or other alkyl or alkylalkoxy cellulose; and any combination thereof.

Reserve Alkalinity

Typically, the laundry detergent composition has a reserve alkalinity of at least 5.0, preferably at least 5.5, or at least 6.0, or at least 6.5, or at least 7.0, or at least 7.5, or at least 8.0, or at least 8.5, or at least 9.0, or at least 9.5, or at least 10.0, or at least 10.5, or at least 11.0, or at least 11.5, or at least 12.0, or at least 13, or at least 14, or at least 15, or at least 16, or at least 17, or at least 18, or at least 19, or at least 20. Preferably, the reserve alkalinity of the composition will not exceed 100.

As used herein, the term "reserve alkalinity" is a measure of the buffering capacity of the laundry detergent composition (g/NaOH/100 g detergent composition) determined by titrating a 1% (w/v) solution of detergent composition with hydrochloric acid to pH 7.5 i.e in order to calculate Reserve Alkalinity as defined herein:

$$\text{Reserve Alkalinity (to pH 7.5) as \% alkali in g NaOH/100 g product} = \frac{T \times M \times 40 \times \text{Vol}}{10 \times \text{Wt} \times \text{Aliquot}}$$

T=titre (ml) to pH 7.5
M=Molarity of HCl=0.2
40=Molecular weight of NaOH
Vol=Total volume (ie. 1000 ml)
W=Weight of product (10 g)
Aliquot=(100 ml)

Obtain a 10 g sample accurately weighed to two decimal places, of fully formulated detergent composition. The sample should be obtained using a Pascall sampler in a dust cabinet. Add the 10 g sample to a plastic beaker and add 200 ml of carbon dioxide-free de-ionised water. Agitate using a magnetic stirrer on a stifling plate at 150 rpm until fully dissolved and for at least 15 minutes. Transfer the contents of the beaker to a 1 liter volumetric flask and make up to 1 liter with deionised water. Mix well and take a 100 mls±1 ml aliquot using a 100 mls pipette immediately. Measure and record the pH and temperature of the sample using a pH meter capable of reading to ±0.01 pH units, with stifling, ensuring temperature is 21° C.+/−2° C. Titrate whilst stirring with 0.2 M hydrochloric acid until pH measures exactly 7.5. Note the milliliters of hydrochloric acid used. Take the average titre of three identical repeats. Carry out the calculation described above to calculate RA to pH 7.5.

Preferably, the reserve alkalinity of the detergent composition will be greater than 7.5 and preferably greater than 8. The reserve alkalinity may be greater than 9 or even greater than 9.5 or 10 or higher. The RA may be up to 20 or higher.

Adequate reserve alkalinity may be provided, at least in part, for example, by one or more of alkali metal silicates (excluding crystalline layered silicate), typically amorphous silicate salts, generally 1.0 to 2.2 ratio sodium salts, alkali metal, typically sodium, carbonate, bicarbonate and/or sesquicarbonates, persalts such as perborates and percarbonates also contribute to alkalinity. Sodium percarbonate may also be used. Highly preferably, the laundry detergent composition comprises an alkalinity source selected from sodium metasilicate, sodium hydroxide, and mixtures thereof.

pH

Preferably, the laundry detergent composition has a pH of less than 11.0 at a concentration of 1 g/L in de-ionized water at a temperature of 20° C. Preferably the laundry detergent composition has a pH of less than 10.5, or less than 10.0, or even less than 9.5 at a concentration of 1 g/L in de-ionized water at a temperature of 20° C.

However, the laundry detergent may have a pH of at least 11.0 at a concentration of 1 g/L in de-ionized water at a temperature of 20° C. If the laundry detergent composition has such higher pH profiles, then preferably the laundry detergent composition comprises greater than 10 wt %, preferably greater than 12 wt %, or greater than 15 wt %, or greater than 17 wt %, or greater than 20 wt %, or greater than 22 wt %, or greater than 25 wt % alkalinity source.

Preferred alkalinity sources include: alkali metal silicates (excluding crystalline layered silicate), typically amorphous silicate salts, generally 1.0 to 2.2 ratio sodium salts; alkali metal, typically sodium, carbonate, bicarbonate and/or sesquicarbonates; persalts such as perborates and percarbonates also contribute to alkalinity; and mixture thereof. Sodium percarbonate may also be used. Highly preferably, the laundry detergent composition comprises an alkalinity source selected from sodium metasilicate, sodium hydroxide, and mixtures thereof.

The pH may be determining by dissolving or diluting the laundry detergent composition to a concentration of 1 g/L at a temperature of 20° C. and determining the pH by any suitable method, such as using a pH meter.

EXAMPLES 30 g of the following free-flowing particulate laundry detergent compositions were used to wash 3.0 kg fabric in a Miele 3622 front-loading automatic washing machine (13 L wash liquor volume, short wash cycle (1 h, 25 mins), 12° C. wash temperature).

| Ingredient | Composition A | Composition B | Composition C | Composition D |
|---|---|---|---|---|
| Bleaching ingredient* | 0.05 wt % | 0.1 wt % | 0.05 wt % | 0.01 wt % |
| Tetraacetylethylenediamine (TAED) | 10.0 wt % | 7.5 wt % | 12 wt % | 10 wt % |
| Coated sodium percarbonate (PC3) | 10.0 wt % | 15 wt % | 12 wt % | 10 wt % |
| Hydroxyethane di[methylene phosphonic acid] (HEDP) | 0.5 wt % | 0.5 wt % | 0.1 wt % | 0.8 wt % |
| $C_{11-13}$ alkyl benzene sulphonate (LAS) | 20.0 wt % | 25 wt % | 15 wt % | 20 wt % |
| Ethoxylated $C_{12-15}$ alkyl sulphate having average degree of ethoxylation of between 1 and 3 ($AE_{1-3}S$) | 5.0 wt % | 5 wt % | 10 wt % | 7 wt % |
| mono-$C_{8-10}$ alkyl mono-hydroxyethyl di-methyl quaternary ammonium chloride | 1.0 wt % | 0.5 wt % | 2.0 wt % | 1.5 wt % |
| Sodium sulphate | 3.0 wt % | 0 wt % | 0 wt % | 1 wt % |
| Sodium carbonate | 25.0 wt % | 20 wt % | 30 wt % | 22 wt % |
| Sodium silicate (1.6R) | 2.0 wt % | 0 wt % | 0 wt % | 1.0 wt % |
| Zeolite 4A | 2.0 wt % | 0 wt % | 0 wt % | 1.0 wt % |
| Florescent whitening agent | 0.5 wt % | 0.5 wt % | 0.1 wt % | 0.5 wt % |
| Silicone suds suppressor | 0.05 wt % | 0.05 wt % | 0.1 wt % | 0.05 wt % |
| Enzymes (protease, amylase, cellulase and mixtures thereof) | 2.0 wt % | 1.0 w % | 1.5 wt % | 2.0 wt % |
| Co-polymer of maleic acid and acrylic acid (MA/AA) | 8.0 wt % | 10 wt % | 12 wt % | 10 wt % |
| Polyethylene oxide with pendant polyvinylacetate groups | 2.0 wt % | 4.0 wt % | 1.0 wt % | 1.5 wt % |
| Carboxymethyl cellulose (CMC) | 1.0 wt % | 2.0 wt % | 1.0 wt % | 1.2 wt % |
| Repel-o-tex | 0.1 wt % | 0 wt % | 0.2 wt % | 0.15 wt % |
| Moisture & Miscellaneous | to 100 wt % | to 100 wt % | to 100 wt % | to 100 wt % |

*bleach ingredient is sulphuric acid mono-[2-(3,4-dihydro-isoquinolin-2-yl)-1-(2-butyl-octyloxymethyl)-ethyl] ester, internal salt.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

What is claimed is:

1. A method of laundering fabric comprising the step of contacting a laundry detergent composition to water to form a wash liquor, and laundering fabric in said wash liquor, wherein the wash liquor has a temperature of above 0° C. to 20° C., and wherein the laundry detergent composition comprises greater than 1 wt % detersive surfactant, other detergent ingredients, a layered particle and perfume microcapsules, wherein the layered particle comprises a core and a layer, wherein the core comprises a source of hydrogen peroxide, wherein the layer comprises a binder and tetraacetyl ethylene diamine, and wherein the weight ratio of the source of hydrogen peroxide to tetraacetyl ethylene diamine present in the layered particle is in the range of from about 5:1 to about 1.1:1.

2. A method according to claim 1, wherein the laundry detergent composition further comprises a bleach ingredient selected from:

(a) bleach ingredient having a log $P_{o/w}$ of no greater than about 0, wherein the bleach ingredient is capable of generating species having a $X_{SO}$ of from about 0.01 to about 0.30, and wherein the bleach ingredient has a structure corresponding to general formula below:

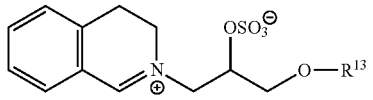

wherein $R^{13}$ is selected from the group consisting of 2-ethylhexyl, 2-propylheptyl, 2-butyloctyl, 2-pentylnonyl, 2-hexyldecyl, n-dodecyl, n-tetradecyl, n-hexadecyl, n-octadecyl, iso-nonyl, iso-decyl, iso-tridecyl and iso-pentadecyl; and/or (b) transition metal bleach catalyst; and/or (c) pre-formed peracid; and/or (d) coated source of hydrogen peroxide, and wherein the bleach ingredient is encapsulated or coated, and wherein the laundry detergent composition comprises from above 0 wt % to 10 wt % of the source of hydrogen peroxide.

3. A method according to claim 1, wherein the laundry detergent composition further comprises a chelent selected from:

(a) ethylene diamine-N'N'-disuccinic acid or salt thereof (EDDS); and/or (b) 4,5-dihydroxy-m-benzenedisulfonic acid disodium salt.

4. A method according to claim 1, wherein the laundry detergent composition further comprises a hueing agent.

5. A method according to claim 1, wherein the laundry detergent composition further comprises an enzyme.

6. A method according to claim 1, wherein the laundry detergent composition has one of the following features:

(a) a reserve alkalinity of 5 or greater; and/or (b) a pH of less than 11.0 at a concentration of 1 g/L in de-ionized water at a temperature of 20° C.; or (c) comprises greater than 10.0 wt % alkalinity source, and has a pH of at least 11.0 at a concentration of 1 g/L in de-ionized water at a temperature of 20° C.

7. A method according to claim 1, wherein the laundry detergent composition is:

(a) essentially free of zeolite builder: and (b) essentially free of phosphate builder.

8. A method according to claim 1, wherein the laundry detergent composition comprises detersive surfactant selected from:

(a) alkyl ethoxylated sulphate having an average degree of ethoxylation of from 0.5 to 3.5; and/or (b) predominantly $C_{12}$ alkyl sulphate.

9. A method according to claim 1, wherein the laundry detergent composition further comprises a polymer selected from:

(a) an amphilic graft polymer, preferably the amphilic graft polymer comprises:

(i) polyethylene glycol backbone; and (ii) at least one pendant moiety selected from polyvinyl acetate, polyvinyl alcohol and mixtures thereof; and/or (b) cellulosic based polymer, preferably carboxymethyl cellulose; and/or (c) polymeric carboxylate; and/or (d) cationic polymer.

10. A method according to claim 1, wherein the laundry detergent composition is in a form selected from:

(a) solid; and/or (b) liquid; and/or (c) unit dose.

11. A method according to claim 1, wherein the laundry detergent composition further comprises from 0 wt % to 40 wt % water.

12. A method according to claim 1, wherein the wash liquor has a temperature of from above 0° C. to 15° C.

13. A method of laundering fabric comprising the step of contacting a solid laundry detergent composition to water to form a wash liquor, and laundering fabric in said wash liquor, wherein the wash liquor has a temperature of above 0° C. to 20° C., and wherein the solid laundry detergent composition comprises:

(a) alkyl ethoxylated sulphate having an average degree of ethoxylation of from 0.5 to 3.5;

(b) essentially free of zeolite builder;

(c) essentially free of phosphate builder;

(d) enzyme;

(e) bleach catalyst having a structure corresponding to general formula below:

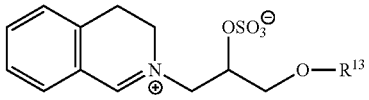

wherein $R^{13}$ is selected from the group consisting of 2-ethylhexyl, 2-propylheptyl, 2-butyloctyl, 2-pentylnonyl, 2-hexyldecyl, n-dodecyl, n-tetradecyl, n-hexadecyl, n-octadecyl, iso-nonyl, iso-decyl, iso-tridecyl and iso-pentadecyl;

(f) layered particle, wherein the layered particle comprises a core and a layer, wherein the core comprises a source of hydrogen peroxide, wherein the layer comprises a binder and tetraacetyl ethylene diamine, and wherein the weight ratio of the source of hydrogen peroxide to tetraacetyl ethylene diamine is from about 5:1 to about 1.1:1;

(g) hueing agent; and (h) less than 10 wt % sodium carbonate.

* * * * *